US007464922B2

(12) United States Patent
Kozaki et al.

(10) Patent No.: US 7,464,922 B2
(45) Date of Patent: Dec. 16, 2008

(54) IMAGE-RECORDING APPARATUS, AND RECORDING-MEDIUM SUPPLY DEVICE

(75) Inventors: Daisuke Kozaki, Nagoya (JP); Shingo Ito, Kasugai (JP)

(73) Assignee: Brother Kogyo Kabushiki Kaisha (JP)

( * ) Notice: Subject to any disclaimer, the term of this patent is extended or adjusted under 35 U.S.C. 154(b) by 439 days.

(21) Appl. No.: 11/211,599

(22) Filed: Aug. 26, 2005

(65) Prior Publication Data

US 2006/0071389 A1 Apr. 6, 2006

(30) Foreign Application Priority Data

Aug. 31, 2004 (JP) ..... 2004-252084
Sep. 15, 2004 (JP) ..... 2004-268860

(51) Int. Cl.
*B65H 5/26* (2006.01)
*G03G 15/00* (2006.01)

(52) U.S. Cl. ..... 271/9.11; 271/118; 399/391

(58) Field of Classification Search ..... 271/9.11, 271/118; 399/391; 347/104, 32
See application file for complete search history.

(56) References Cited

U.S. PATENT DOCUMENTS 4,760,751 A * 8/1988 Kasamatsu ..... 74/354
5,831,644 A * 11/1998 Kato ..... 347/22
5,841,450 A * 11/1998 Kawamura ..... 347/32
6,561,618 B1 * 5/2003 Simmons et al. ..... 347/32
6,650,436 B1 * 11/2003 Hamamoto et al. ..... 358/1.9
6,651,974 B2 * 11/2003 Kawarama et al. ..... 271/121
7,059,596 B2 * 6/2006 Iwase ..... 271/114
7,198,263 B2 * 4/2007 Acton ..... 271/9.05
7,225,697 B2 * 6/2007 Schalk et al. ..... 74/405
7,306,216 B2 * 12/2007 Lee et al. ..... 271/10.01

FOREIGN PATENT DOCUMENTS

JP 8-174958 7/1996
JP 2002249248 9/2002

* cited by examiner

*Primary Examiner*—Patrick H Mackey
*Assistant Examiner*—Luis Gonzalez
(74) *Attorney, Agent, or Firm*—Banner & Witcoff, Ltd.

(57) ABSTRACT

An image-recording apparatus including (a) a carriage carrying a recording head, (b) a maintenance unit disposed at a standby position located outside a recording area (L) of the recording head, (c) medium feeding devices to feed recording media from respective cassettes (d) first, second and third gears which are disposed outside the recording area and through which a drive force is selectively transmitted from a drive-force output gear to one of the medium feeding devices and the maintenance device, and (e) a power-transmission switching device having a shift gear which is moved for selective meshing engagement with the first, second and third gears according to a distance of movement of the carriage from the recording area toward the maintenance unit. In at least one of the medium feeding devices, a support arm pivotally supported at its proximal end portion by a drive shaft and rotatably supporting a rotary medium-supply member at its free end portion is biased by a biasing device pivotally about the axis of rotation of the drive shaft in a direction for moving the free end portion toward the stack of recording media, and in an axial direction of the drive shaft against a support frame which rotatably supports the drive shaft.

23 Claims, 25 Drawing Sheets

IMAGE-RECORDING APPARATUS, AND RECORDING-MEDIUM SUPPLY DEVICE

The present application is based on Japanese Patent Application Nos. 2004-252084 and 2004-268860 respectively filed on Aug. 31 and Sep. 15, 2004, the contents of which are incorporated herein by reference.

BACKGROUND OF THE INVENTION

1. Field of the Invention

The present invention relates in general to a recording-medium supply device arranged to feed recording media such as cut sheets one after another from a stack of the recording media, and an image-recording apparatus such as a printer, a copier and a facsimile device including a recording device and the recording-medium supply device to feed the cut sheets to the recording device. The invention is also concerned with an image-recording apparatus wherein the recording-medium supply device has a plurality of medium supply cassettes each of which is arranged to feed the recording media from a stack of the recording media to the recording device of the apparatus.

2. Discussion of Related Art

One type of known image-recording apparatus such as a printer, a copier and a telecopier (facsimile device) uses an ink-jet recording head as a recording device operable to record an image in a matrix of dots, on a recording medium such as a paper sheet while the recording medium is fed. The ink-jet recording head may suffer from a failure to normally eject droplets of ink, due to air bubbles staying within the recording head during its recording operation. To recover the ink-jet recording head from the ink ejection failure, the image-recording apparatus has a maintenance device outside a recording area in which the recording operation by the recording head on the recording medium is possible. This maintenance device includes a purging pump, and a sucking portion which is connected to the purging pump and an ink ejection part (nozzles) or an air-bubble chamber of the recording head and which is periodically operated to remove a volume of the ink that contains the air bubbles.

JP-8-174958A discloses an example of a solution to solve the drawback described above. According to this solution, the recording apparatus is provided with a kicker member actuated by a movement of the recording head in a main scanning direction perpendicular to a secondary scanning direction which is a direction of feeding of the recording medium. The kicker member is arranged to shift an idler gear which selectively meshes with a first gear train for transmitting a drive force from a drive motor to a medium feeding roller platen) to feed the recording medium, or a second gear train for transmitting the drive force to the maintenance device to drive the purging pump, so that the idler gear is shifted into meshing engagement with the second gear train by the kicker member by a movement of the recording head upon operation of the maintenance device.

For easier assembling of the first gear train, second gear train and idler gear, the gears have some amount of clearance with respect to support shafts. Further, the gears inevitably have a backlash between the surfaces of the meshing teeth, due to limited accuracy of shaping of the gear teeth. In view of these clearance and backlash, the drive motor selectively used to feed the recording medium and drive the purging pump is controlled upon a shifting action of the idler gear to selectively mesh with the first or second gear train, such that the drive motor is first rotated in a forward direction by an angle corresponding to a half of a width angle of a tooth of the gears in question, and is then rotated in a reverse direction by an angle corresponding to a multiple of the width angle, for facilitating disengagement of the idler gear from one of the first and second gear trains and engagement of the idler gear with the other gear train.

A recently developed image-recording apparatus is provided with a plurality of medium supply cassettes that accommodate respective stacks of recording media such as paper sheets of different sizes, so that the recording operation is performed on the recording medium of the selected size. The medium supply cassettes are arranged in a stack in the vertical direction below a carriage drive device. According to a signal indicative of the selected size of the recording medium, a medium supply roller is brought into contact with the uppermost one of the recording media of the stack accommodated in a selected one of the medium supply cassettes which corresponds to the selected size, and the uppermost recording media (uppermost paper sheet) is fed by the medium supply roller along a U-turn path extending from one end of the selected medium supply cassette, to the recording portion disposed below the carriage drive device.

Where the image-recording apparatus is provided with a plurality of medium supply cassettes (e.g., two cassettes), however, the above-described power-transmission switching device arranged to shift the idler gear for selective meshing engagement with the first and second gear trains has a drawback. Namely, the power-transmission switching device as applied to the image-recording apparatus provided with two medium supply cassettes, for example, may include a large-diameter idler gear disposed between the first gear train to drive the medium supply roller or the upper medium supply cassette and the second, gear train to drive the purging pump. The first gear train includes a small-diameter gear located on one side of the large-diameter idler gear, while the second gear train includes a small-diameter gear located on the other side of the large-diameter idler gear, and the large-diameter idler gear is kept connected to the drive motor. However, this type of power-transmission switching device does not permit the drive force to be transmitted to a gear train to drive the medium supply roller for the lower medium supply cassette. Therefore, another idler gear is necessary to selectively drive the medium supply rollers for the two medium supply cassettes, and the arrangement to selectively transmit the drive force from the same drive motor to the medium supply rollers for the two medium supply cassettes and the maintenance portion tends to be complicated in construction.

For simplifying control systems for an image-recording apparatus provided with a single medium supply cassette and an image-recording apparatus provided with a plurality of medium supply cassettes (e.g., two cassettes), it is desirable that the above-described control to rotate the drive motor in the forward and reverse directions as disclosed in JP-8-174958A is applicable to those two types of image-recording apparatus.

JP-2002-249248A discloses an example of a recording-medium supply device wherein a medium supply roller for ceding cut sheets stacked in a medium supply cassette is supported by a free end portion of a roller support arm that is pivotally attached to a support shaft which is disposed above the medium supply cassette so as to extend in a direction perpendicular to the feeding direction of the cut sheets. The roller arm is pivotally biased by a spring such that the medium supply roller is held in contact with the uppermost cut sheet of the stack, irrespective of the number of the cut sheets stacked in the medium supply cassette, namely, the height of the stack of the cut sheets.

In the recording-medium supply device constructed as described above, the position of abutting contact of the medium supply roller with the uppermost cut sheet varies in not only the direction of height of the stack of the cut sheets (direction of stacking of the cut sheets) but also the feeding direction of the cut sheets, with a change of the height of the stack, since the roller support arm supporting the medium supply roller at its free end portion is pivotally supported. A large amount of variation in the position of abutting contact of the medium supply roller with the uppermost cut sheet in the feeding direction with a change of the height of the stack undesirably deteriorates the stability of feeding of the cut sheets from the medium supply cassette.

The roller support arm which is attached at its proximal end portion to the support shaft pivotally about the support shaft has some amount of play at its proximal or fixed end portion in the axial direction of the support shaft, which causes a rattling movement of the roller support arm at its proximal end portion in the direction perpendicular to the longitudinal direction of the roller support arm, namely, in the axial direction of the support shaft. This axial rattling movement of the roller support arm at the proximal end portion causes a rattling movement at the free end portion, which is generally larger than that at proximal end portion, due to a clearance between the outer circumferential surface of the support shaft and the inner circumferential surfaces of shaft holes through which the support shaft extends.

Where the medium supply cassette has a relatively large storage capacity, the roller support arm has an accordingly large length, so that the rattling movement at the proximal end portion of the support arm is greatly amplified into the rattling movement at the free end portion, whereby the axis of rotation of the medium supply roller is inclined with respect to the direction perpendicular to the feeding direction. This inclination prevents the medium supply roller from feeding the cut sheets exactly in the feeding direction, giving rise to a risk of jamming of the fed cut sheets in the feeding path.

In the recording-medium supply device disclosed in JP-2002-249248A, auxiliary rollers are provided between a lower medium supply cassette and the recording portion of the image-recording apparatus. Without such auxiliary rollers, an actual path of feeding of the cut sheet fed by the medium supply roller obliquely with respect to the nominal direction of feeding from the cassette greatly deviates from the nominal feeding path between the cassette and registering rollers, resulting in easy jamming of the cut sheet in the feeding path. Where the obliquely fed cut sheet reaches the registering rollers, the cut sheet which is registered by the registering rollers for parallelism of the longitudinal direction of the registered cut sheet with the nominal feeding direction tends to be undesirably shifted in the widthwise direction of the cut sheet, so that an image printed by the recording portion on the registered cut sheet is not correctly centered in the widthwise direction (perpendicular to the feeding direction).

SUMMARY OF THE INVENTION

It is a first object of the present invention to provide an image-recording apparatus which is equipped with one medium supply cassette or a plurality of medium supply cassettes and which has a simple and economical power-transmission switching device for selective transmission of the drive force to the medium supply roller and the maintenance portion and permits an easy control of the selective transmission. It is a second object of this invention to provide an image-recording apparatus which achieves the above-indicated first object and which is equipped with a recording-medium supply device which permits stable feeding of cut sheets from a stack of cut sheets one after another to a recording portion of an image-recording apparatus in a predetermined medium feeding direction.

The first object indicated above may be achieved according to a first aspect of this invention, which provides an image-recording apparatus comprising (a) a recording head operable to record an image on a recording medium, (b) a carriage carrying the recording head and reciprocable in a main scanning direction, (c) a guide device guiding the carriage in the main scanning direction, and (d) a maintenance device disposed at a predetermined standby position located outside a predetermined recording area of the recording head in the main scanning direction and operable to perform a maintenance operation of the recording head when the carriage is located at the standby position, the image-recording apparatus further comprising:

a plurality of medium supply cassettes which are superposed on each other and each of which is open upwards and accommodates a stack of recording media;

a plurality of medium feeding devices which are operable to feed the recording media from the respective stacks accommodated in the plurality of medium supply cassettes, one after another along a feeding path;

a plurality of power transmitting devices disposed on one of opposite sides of the predetermined recording area which corresponds to the standby position, the plurality of power transmitting devices respectively corresponding to the maintenance device and the plurality of medium feeding devices and including respective power transmitting members, the power transmitting member corresponding to the maintenance device being located furthest from the recording area in the main scanning direction, while the power transmitting member corresponding to an uppermost one of the plurality of medium feeding devices being located nearest to the recording area in the main scanning direction;

a drive-force output device operable to produce a drive force; and a power-transmission switching device operable to transmit the drive force selectively to one of the power transmitting members, according to a distance of movement of the carriage in the main scanning direction from one of opposite ends of the recording area which corresponds to the above-indicated one of the opposite sides.

In the image-recording apparatus according to the above-described aspect of this invention constructed as described above, the power transmitting member corresponding to the uppermost one of the plurality of medium feeding devices is located nearest to the recording area in the direction of movement of the carriage, and the at least one power transmitting member corresponding to the at least one remaining medium feeding device is spaced from the power transmitting member corresponding to the uppermost medium feeding device, in the direction away from the recording area, while the power transmitting member corresponding to the maintenance portion is located furthest from the recording area. Accordingly, the drive force is transmitted from the drive-force output device through the power-transmission switching device, to a selected one of the uppermost medium feeding device, the lower medium feeding device or devices, and the maintenance portion, by moving the carriage in the main scanning direction from the recording area toward the predetermined standby position. Accordingly, the power-transmission switching device is applicable to the image-recording apparatus, irrespective of the number of the medium supply cassettes (the number of the medium feeding devices), so that different models of the image-recording apparatus having respective different medium supply cassettes are available at a relatively low cost, by using the same arrangement of power-transmission switching device and the respective different numbers of the power transmitting devices corresponding to the medium supply cassettes (medium feeding devices).

According to a second aspect of the present invention, each of the plurality of medium feeding devices includes a drive shaft connected to the drive-force output device and rotatably supported by a support frame, a support arm having a free end portion and a proximal end portion through which the drive shaft extends rotatably, and a rotary medium-supply member rotatably supported by the free end portion of the support arm and rotated by the drive shaft, and wherein at least one of the plurality of medium feeding devices further includes a biasing device which biases the support arm pivotally about an axis of rotation of the drive shaft in a direction for moving the free end portion toward the stack of recording media, while at the same time biases the support arm in an axial direction of the drive shaft against the support frame.

According to the above-described second aspect of the image-recording apparatus, the second object indicated above may be achieved.

It will be appreciated that a recording-medium supply device comprising a medium feeding device operable to feed recording media one after another from a stack of the recording media, the recording-medium supply device further comprises; (a) a drive source; (b) a support frame; (c) a drive shaft connected to the drive source and rotatably supported by the support frame; (d) a support arm having a free end portion, and a proximal end portion through which the drive shaft extends rotatably; (e) a rotary medium-supply member rotatably supported by the free end portion of the support arm and rotated by the drive shaft; and (f) a biasing device which biases the support arm pivotally about an axis of rotation of the drive shaft in a direction for moving the free end portion toward the stack of recording media, while at the same time biases the support arm in an axial direction of the drive shaft against the support frame.

In the recording-medium supply device constructed as described above, the support arm is biased by the biasing device pivotally about the axis of rotation of the drive shaft in a direction for moving the free end portion toward the stack of recording media, so that the rotary medium-supply member is normally held in pressing contact with the top surface of the stack of recording media, irrespective of a height of the stack, whereby the recording media can be fed by the rotary medium-supply member with a high degree of stability.

Further, the support arm is biased against the support frame by the biasing device also in the axial direction of the drive shaft, so as to reduce a rattling movement of the support arm in the axial direction of the drive shaft and an inclination of the longitudinal direction of the support arm with respect to the medium feeding direction, whereby the recording media can be fed exactly in the medium feeding direction.

The present recording-medium supply device is available at a relatively low cost owing to simple construction of the biasing device, which is preferably a single torsion spring.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
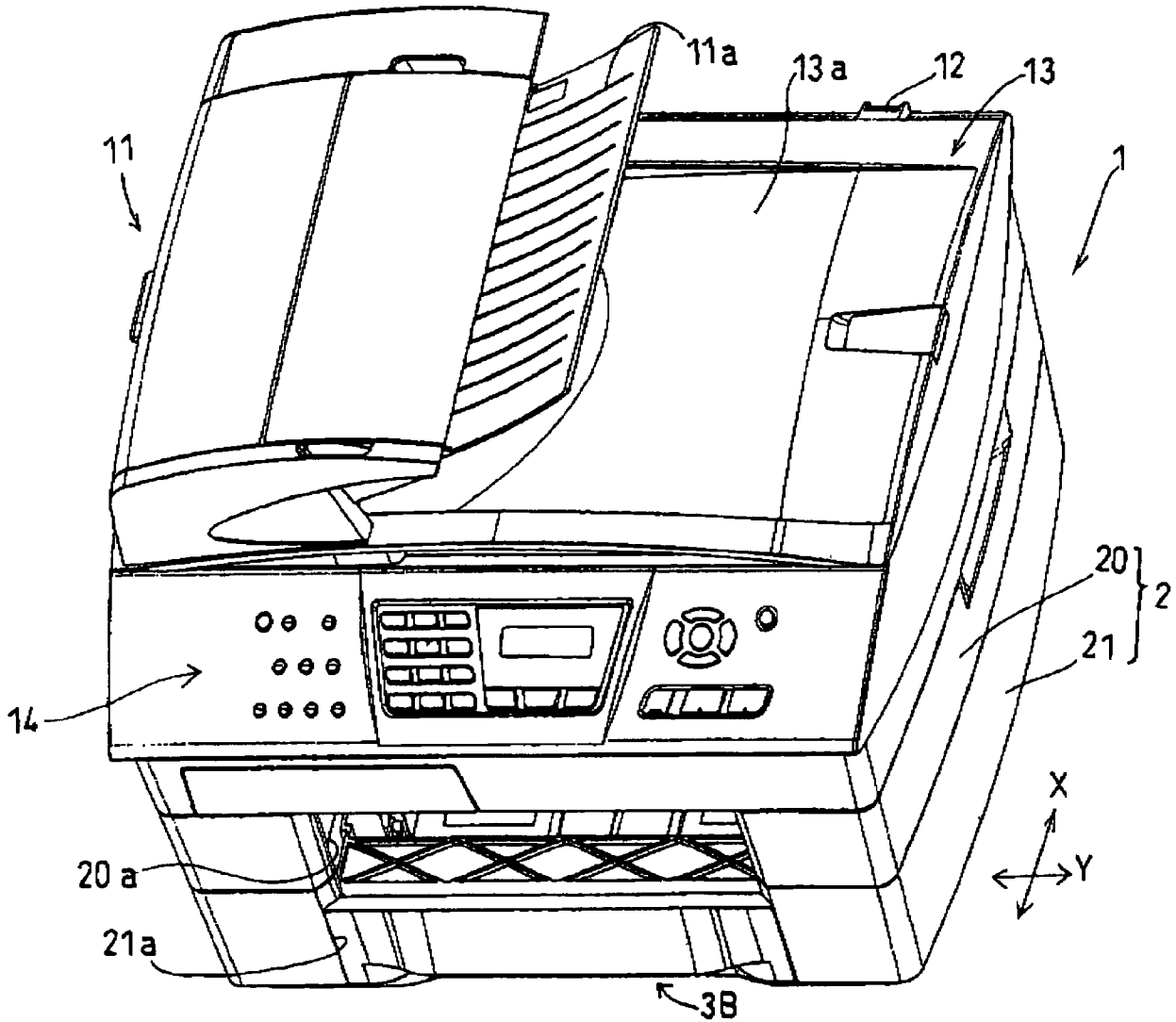
FIG. 1 is a perspective view of an image-recording apparatus constructed according to one embodiment of this invention.

Referring to FIGS. 1-15, there is shown an image-recording apparatus 1 in the form of a multi-function device constructed according to one embodiment of the present invention, which has a printing function, a copying function, a scanning function and a facsimile function. As shown in FIG. 1, the image-recording apparatus 1 has a housing 2 formed of a synthetic resin and including a first lower casing 20 and a second lower casing 21 which are superposed on each other. The first and second lower casings 20, 21 have respective front openings 20*a*, 21*a* at a front end of the housing 2. An upper first sheet supply cassette 3A (shown in FIGS. 2 and 4) is insertable through the front opening 20*a* into the first lower casing 20, while a lower second sheet supply cassette 3B (shown in FIG. 1) is insertable through the front opening 21*a* into the second lower casing 21. In the apparatus 1 as shown in FIG. 1, the second sheet supply cassette 3B is accommodated in the housing 2, but the first sheet supply cassette 3A is removed from the housing 2. In the following description, the side, the end portion and the end of the housing 2, first and second lower casings 20 and 21, first and second sheet supply cassettes 3A and 3B and the related components, which are nearer to the front openings 20*a*, 21*a*, will be referred to as the "front side", "front end portion" and "front end", and the side, end portion or end which are opposite to the front side, front end portion and front end will be referred to as the "rear side", "rear end portion" and "rear end".

Figure 2:
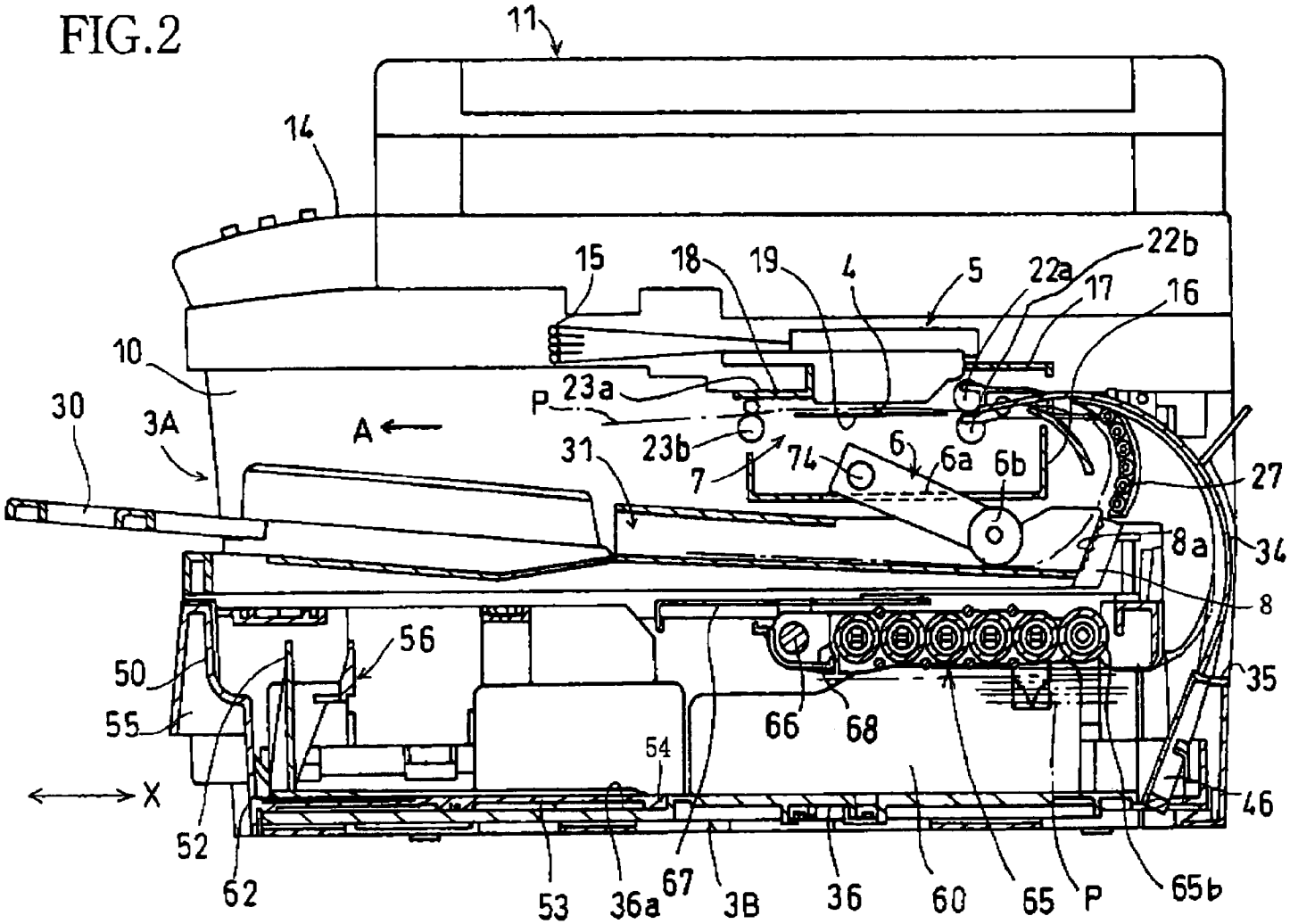
FIG. 2 is a side elevational view in cross section showing a sheet supply device of the image-recording apparatus.

In or on an upper portion of the housing 2, there are provided an image-reading device (not shown) and an operator's control panel 14. The image-reading device includes an automatic original feeder 11 arranged to feed an original for reading an image on the original when the apparatus 1 is operated as a copier or a facsimile device. The operator's control panel 14 is located in front of the automatic original feeder 11, and has various control buttons and keys, a liquid crystal display, etc., as shown in FIGS. 1 and 2. The image-forming device has a glass plate (not shown) on which the original is placed, and an original covering member 13 which is provided to cover the original and the glass plate and which is pivotally connected at its rear end to the rear end of the image-reading device through a hinge device 12 such that the original covering member 13 is pivotable about the hinge device 12. The original is placed on the glass plate when the original covering member 13 is opened upwards such that a surface of the original to be read faces downwards. An image scanner device CIS (contact image sensor) is movable mounted on a support shaft located disposed below the glass plate such that the image scanner device is reciprocable in a main scanning direction perpendicular to the planes of FIGS. 2 and 4, that is, in a Y-axis direction indicated in FIG. 1, to read the image on the original. The automatic original feeder 11 is provided with an original supply tray 11*a* on which originals are placed such that a surface (an image surface) of each original to be read faces upwards. The original is fed from the original supply tray 11*a* along a U-curved feed path, which includes an upper arm part extending downwards and leftwards from the original supply tray 11*a*, and a lower arm part below which an original reader (below a left end portion of the glass plate as seen in FIG. 1) is disposed. The original reader reads an image of the original while the original is moved along the lower arm part of the feed path. The original covering member 13 is provided on its upper surface with an original receiver tray 13*a* for receiving the originals fed from the original supply tray 11*a* such that the original is placed on the original receiver tray 13*a*, with its image surface facing downwards.

Figure 3:
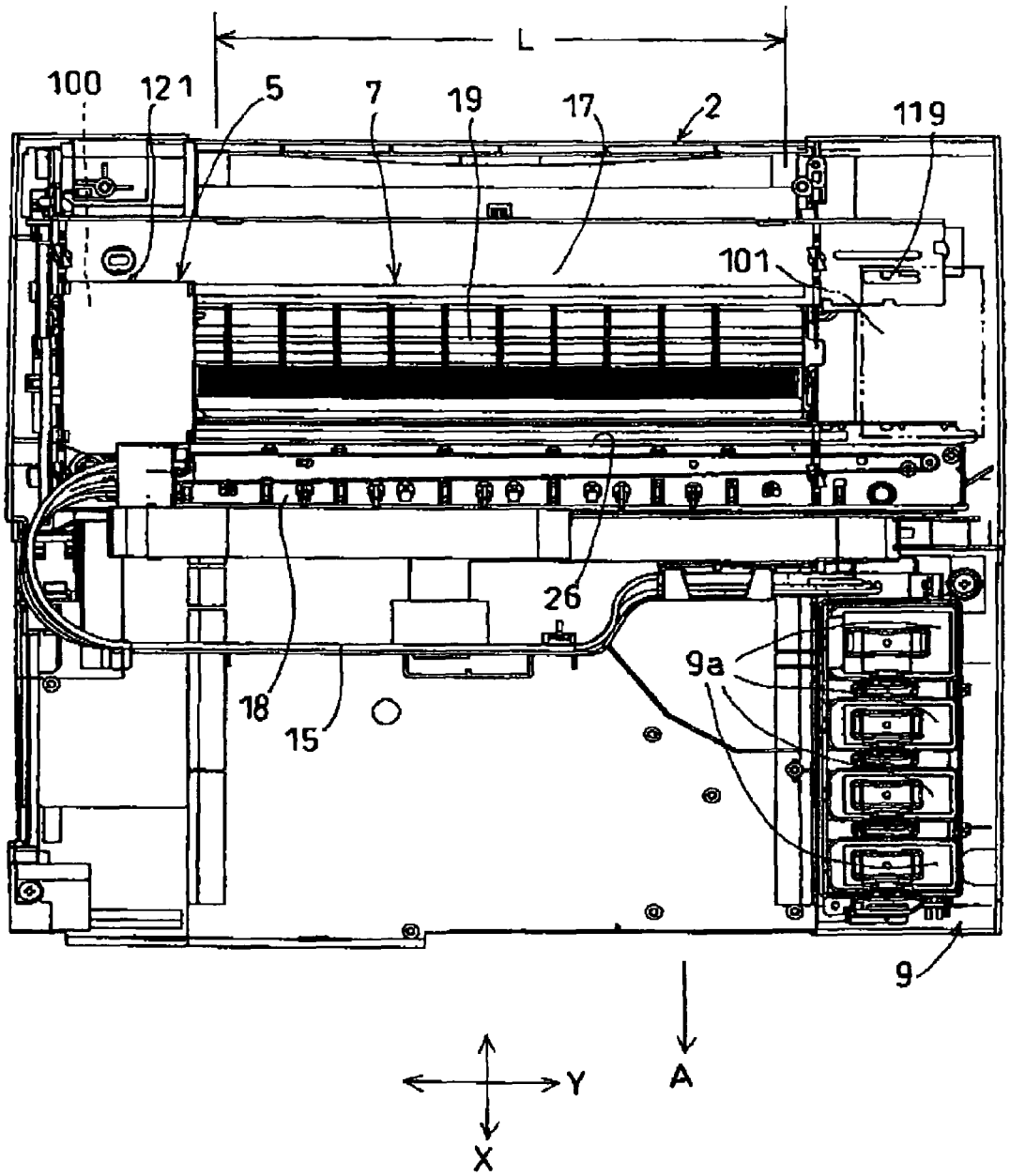
FIG. 3 is a plan view of the image-recording apparatus, with its image-reading portion removed.
Figure 4:
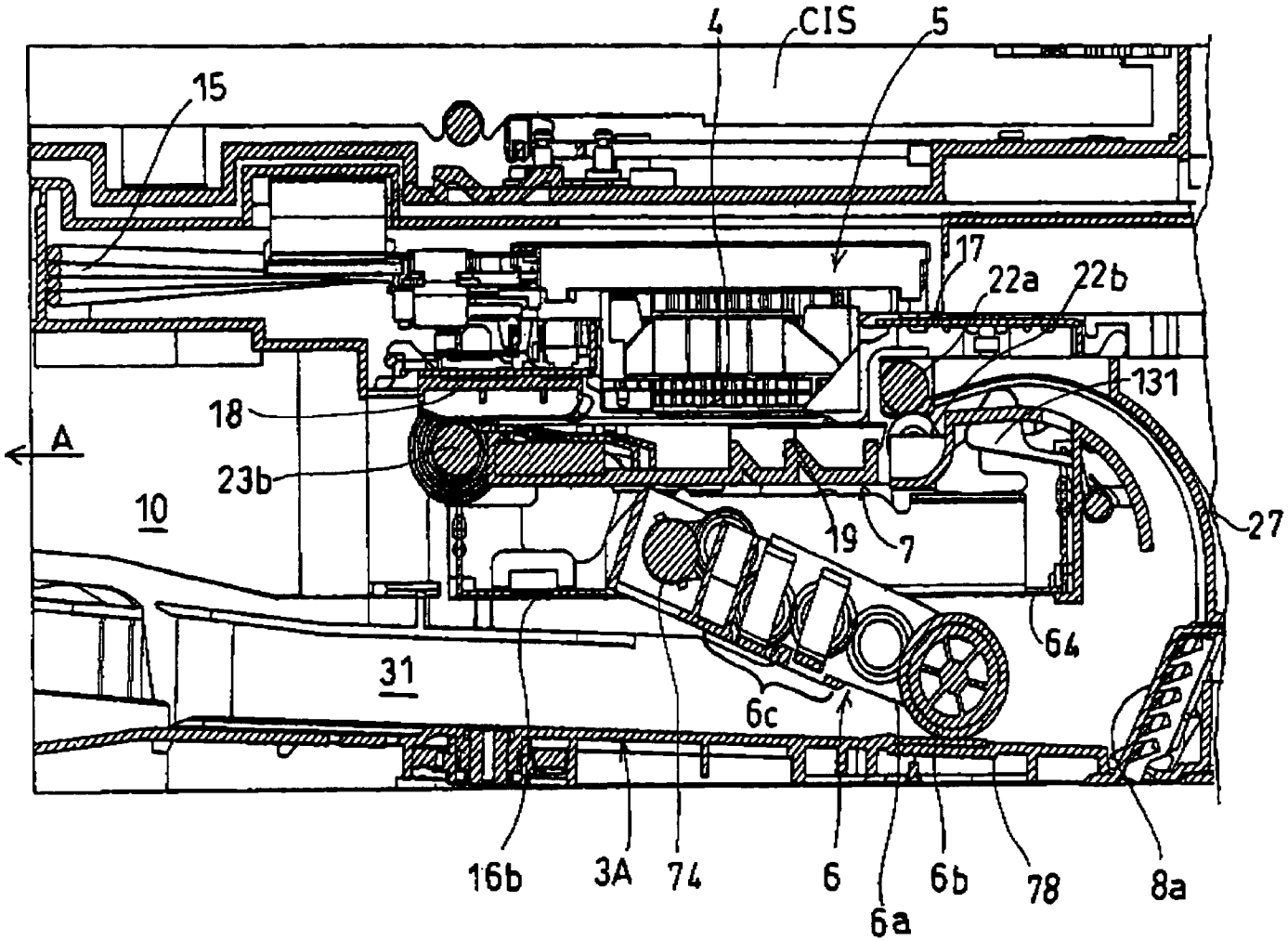
FIG. 4 is an enlarged side elevational view in cross section showing an upper first sheet supply cassette and a recording portion of the image-recording apparatus.

Under the operator's control panel 14 and the image-reading device, there are disposed an image-recording portion 7, a recorded-sheet receiver 10, and an ink reservoir portion 9, as shown in FIGS. 2-4.

As shown in FIG. 3, the ink reservoir portion 9 is open upwards toward the upper end of the housing 2, and includes ink cartridges 9*a* which are arranged in a straight row in an X-axis direction and which are removably installed in the vertical direction. The four ink cartridges 9*a* accommodate inks of respective four colors for full-color imaging, namely, black (BK), cyan (C), magenta (M) and yellow (Y), and each ink cartridge 9*a* has a rectangular box structure having a relatively small surface area as seen in the plan view of FIG. 3 and a relatively large height dimension.

The image-recording portion 7 includes an ink-jet recording head 4 to which the inks are supplied from the four ink cartridges 9*a* through respective four ink supply tubes 16, as shown in FIG. 3.

As shown in FIGS. 2-4, 8 and 9, the image-recording portion 7 has a main frame 16 (shown in FIGS. 8 and 9) of box structure which is formed from metal sheets and which includes right and left side plates 16*a*. The image-recording portion 7 includes: a first guide member 17 and a second guiding member 18 each in the form of an elongate plate, which are supported by the side plates 16*a* and extend in the Y-axis direction (main scanning direction); a second guiding member 18 and which are disposed such that the first guide member 17 is located upstream of the second guide member 18 in a feeding direction A (indicated in FIG. 2) of a cut sheet P; a carriage 5 which carries the recording head 4 and which is mounted on the first and second guide members 17, 18, so as to bridge these two guide members 17, 18, such that the carriage 5 is slidably movable on the guide members 17, 18; a timing belt (not shown) extending parallel to the upper surface of the second guide member 18 and provided to reciprocate the carriage 5; a carriage drive motor 25 (indicated in FIG. 16) operable to reciprocate the carriage 5 through the timing belt; a platen 19 in the form of an elongate plate located below the recording head 4 and provided to support a cut sheet P; and a Y-axis encoder 26 in the form of a strip extending in the main scanning direction and provided to detect the position of the carriage 5 in the Y-axis direction (main scanning direction).

The image-recording portion 7 has a recording area L (indicated in FIG. 8) set in the direction of width of the cut sheet P (perpendicular to the feeding direction A), in which a recording operation by the recording head 4 on the cut sheet P is possible. On one side of this recording area L, more precisely, on the left side of the recording area L near the left side plate 16*a*, there is provided an ink receiver 100, as shown in FIG. 3. On the other or right side of the recording area L near the right side plate 16*a*, there is provided a maintenance portion in the form of a maintenance unit 101 (which will be described by reference to FIG. 9). When the recording head 4 is located at a predetermined flushing position right above the ink receiver 100, the recording head 4 is operated to perform a periodic ink ejecting operation for preventing clogging or plugging of its nozzles, during a normal recording operation. The ink ejected from the nozzles during this periodic ink ejecting operation is stored in the ink receiver 100. While the recording head 4 is not in operation, it is located at a predetermined standby position in which one of four rows of nozzles of the recording head 4 corresponding to the four colors is selectively brought into contact with a cap portion 101*a* (shown in FIG. 9) of the maintenance unit 101 located below the recording head 4, so that the ink is sucked out from the selected row of nozzles, or air bubbles are removed from a buffer tank (not shown) of the recording head 4. Thus, the recording head 4 is subjected to a maintenance operation by the maintenance unit 101 at the standby position. When the carriage 5 is moved in the Y-axis direction from the recording area L toward the standby position (toward the maintenance unit 101), a cleaner in the form of a wiper blade (not shown) is moved up for contact with the nozzle surface of the recording head 4 for cleaning the nozzle surface.

On the upstream side of the platen 19 as viewed in the feeding direction A, there are disposed a pair of registering rollers 22*a*, 22*b* which are located above and below a plane of the platen 19, as shown in FIG. 2. The cut sheet P fed through a pressure nip between the registering rollers 22*a*, 22*b* is advanced between the lower surface of the recording head 4 and the upper surface of the platen 19, as shown in FIG. 2. On the downstream side of the platen 19, there are disposed a spur roller 23*a* for contact win the upper surface (recorded surface) of the cut sheet P, and a sheet ejector roller 23*b* for contact with the lower surface (non-recorded surface) of the cut sheet P. The cut sheet P on which the recording operation by the image-recording portion 7 has been performed is ejected into the recorded-sheet receiver 10, with the recorded surface of the cut sheet P facing upwards. The recorded-sheet receiver 10 is formed above the first sheet supply cassette 3A, as shown in FIG. 2, and the housing 2 has a front opening which communicates with the recorded-sheet receiver 10 and which is located above the front opening 20*a*.

Figure 5:
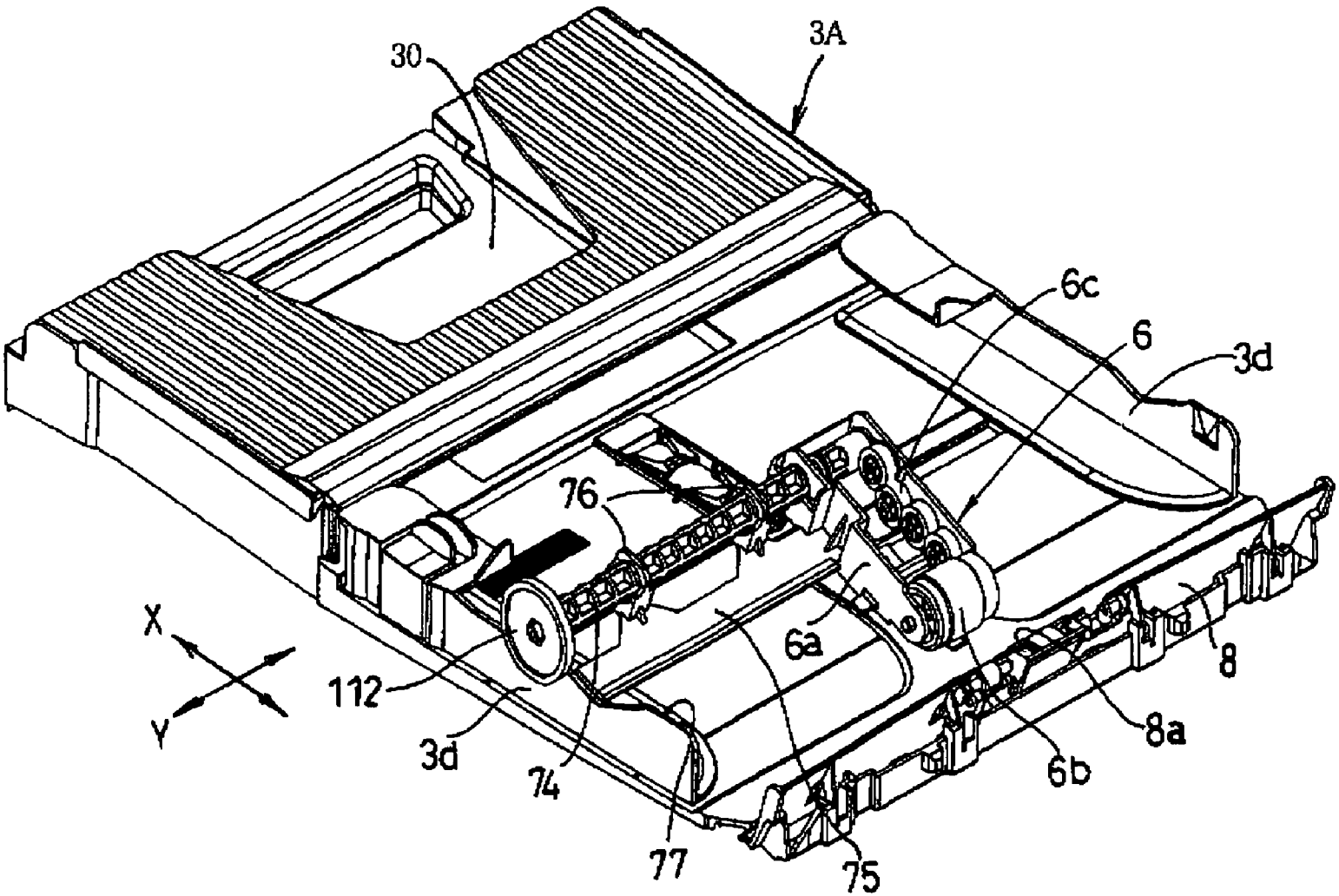
FIG. 5 is a perspective view of the first sheet supply cassette.
Figure 6:
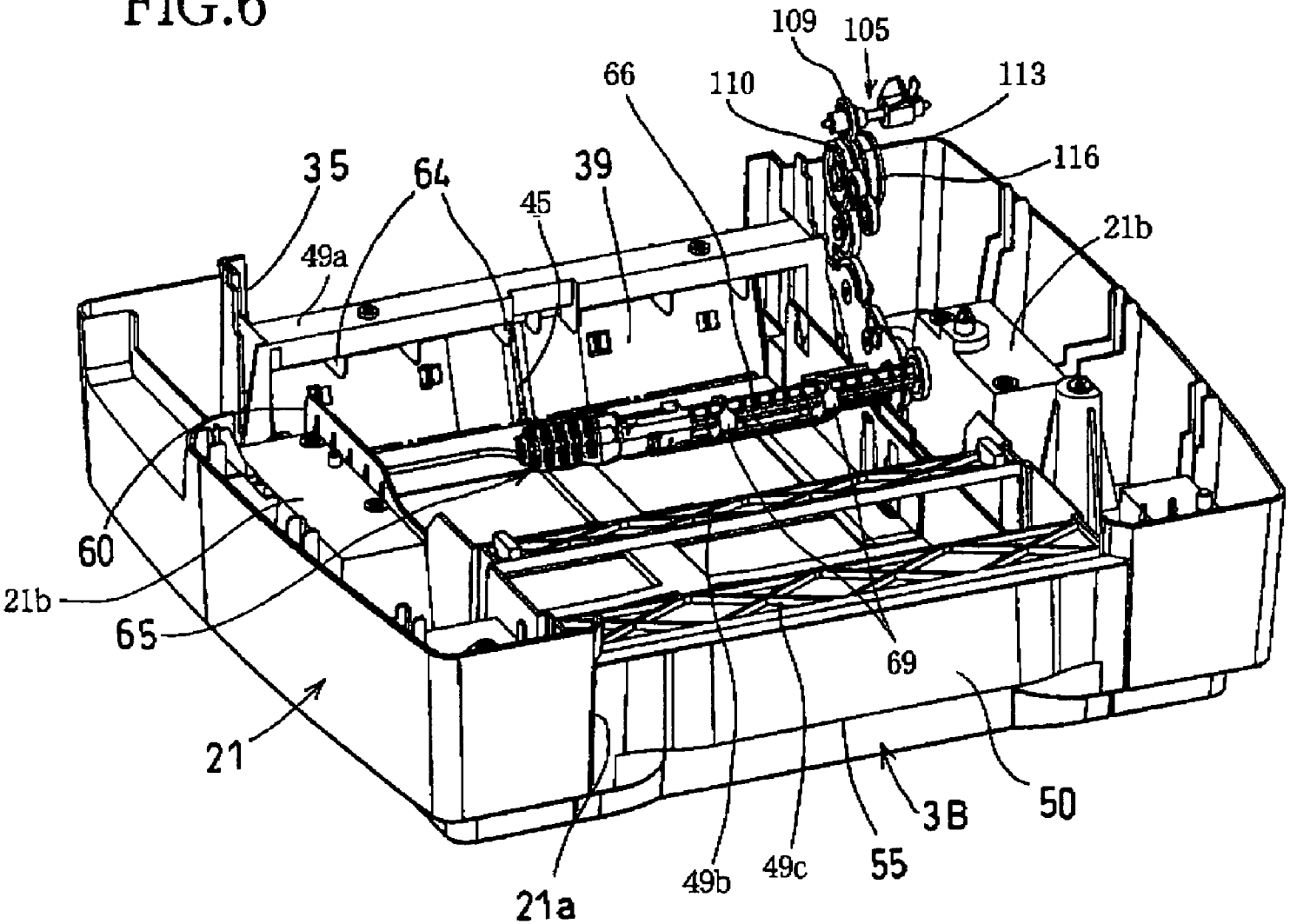
FIG. 6 is a perspective view showing a lower second sheet supply cassette accommodated in a second lower casing.

Referring further to FIGS. 5-7 as well as FIGS. 2 and 4, there will be described in detail a recording-medium supply device including the upper first sheet supply cassette 3A and the lower second sheet supply cassette 3B. The first and second sheet supply cassettes 3A, 3B are provided with respective first and second sheet feeding devices 6, 65, as shown in FIGS. 2, 5 and 6.

The first sheet supply cassette 3A has a storage portion 31 for accommodating a recording medium in the form of a stack of cut sheets P of a selected size such as the A4 size, letter size, legal size or postcard size, such that the width direction of each cut sheet P parallel to its two parallel short sides is parallel to the main scanning direction or the Y-axis direction which is perpendicular to the feeding direction A of the cut sheet P (secondary scanning direction or X-axis direction). As shown in FIG. 2, the first sheet supply cassette 3A is provided at its front end portion near the front opening 30*a*, with an auxiliary support member 30 which is provided to support a rear end portion of the stack of legal-size cut sheets P having a relatively large length and which is movable in the X-axis direction. While FIG. 2 shows the auxiliary support member 30 in its advanced position projecting outwardly of the housing 2, the auxiliary support member 30 is movable from the advanced position to its fully retracted position in which the auxiliary support member 30 is accommodated within the first sheet supply cassette 3A, as shown in FIG. 5. The auxiliary support member 30 is placed in its fully retracted position where the first sheet supply cassette 3A accommodates a stack of A4-size cut sheets P, the length of which is short enough to permit the stack to be entirely accommodated within the cassette 3A, without the rear end portion of the stack projecting outwardly from the first lower casing 20 through the font opening 20*a*.

At the rear end portion of the upper first sheet supply cassette 3A, there is disposed an inclined sheet separator plate 8, as shown in FIGS. 2 and 5. The first sheet feeding device 6 includes a roller support arm 6*a* which is supported at its upper end portion by the housing 2 such that the roller support arm 6*a* is pivotable about a horizontal axis. The roller support arm 6*a* carries at its lower end (free end) a rotary medium-supply member in the form of a sheet supply roller 6*b*, which cooperates with the sheet separator plate 8 to separate the uppermost cut sheet P from the stack accommodated in the first sheet supply cassette 3A, and feed this cut sheet P along a U-turn path which is defined by a first-path member 27 leading to the image-recording portion 7 disposed above the first sheet supply cassette 3A. The sheet separator plate 8 is an elongate member extending in the width direction of the cut sheet P (in the Y-axis direction), and has a longitudinally central portion which is convex toward the sheet supply roller 6*b* and which corresponds to a widthwise central portion of the cut sheet P. The two longitudinal portions of the sheet separator plate 8 on the opposite sides of the central convex portion are inclined so as to be retracted toward the rear end of the first sheet supply cassette 3A as they extend toward the respective opposite longitudinal ends in the longitudinal direction of the sheet separator plate 8, that is, in the width direction of the cut sheet P. Thus, the sheet separator plate 8 has a convex shape in cross section taken in the horizontal plane. The central convex portion of the sheet separator plate 8 is provided with a saw-toothed elastic separator pad 8*a* for contact with the leading edge of the uppermost cut sheet P, to promote the separation of the cut sheet P from the stack.

The second sheet supply cassette 3B accommodate a stack of cut sheets P of a selected one of the sizes described above with respect to the first sheet supply cassette 3A. However, this second sheet supply cassette 3B has a larger height dimension than the first second sheet supply cassette 3A, so that the maximum height of the stack that can be accommodated in this second sheet supply cassette 3B is larger than that of the first sheet supply cassette 3A. In the present embodiment, the second lower casing 21 in which the second sheet supply cassette 3B is installed is fixed to the underside of the first lower casing 20, by screws or any other suitable fastening means.

Figure 7A:
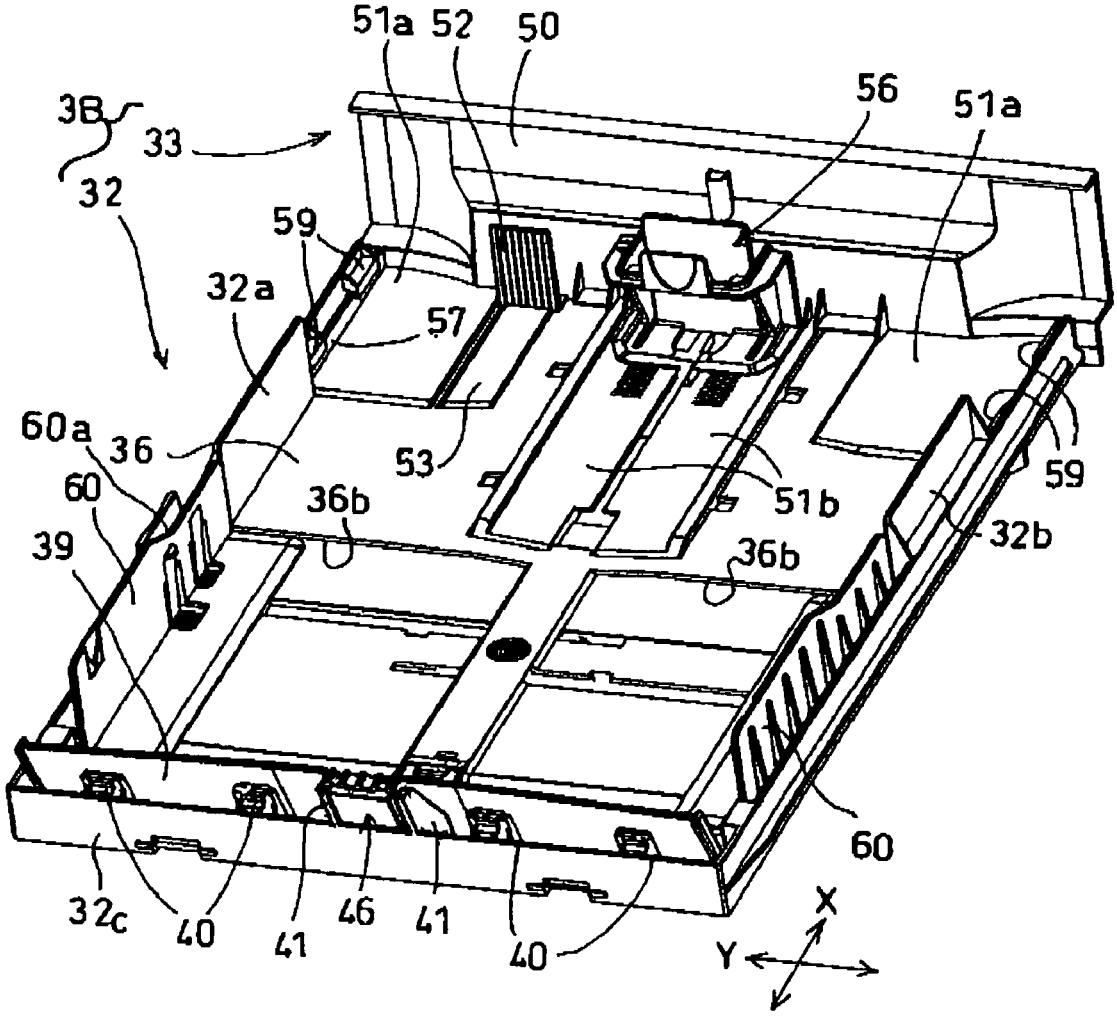
FIG. 7A is a perspective view showing the second sheet supply cassette in its longitudinally contracted state.
Figure 7C:
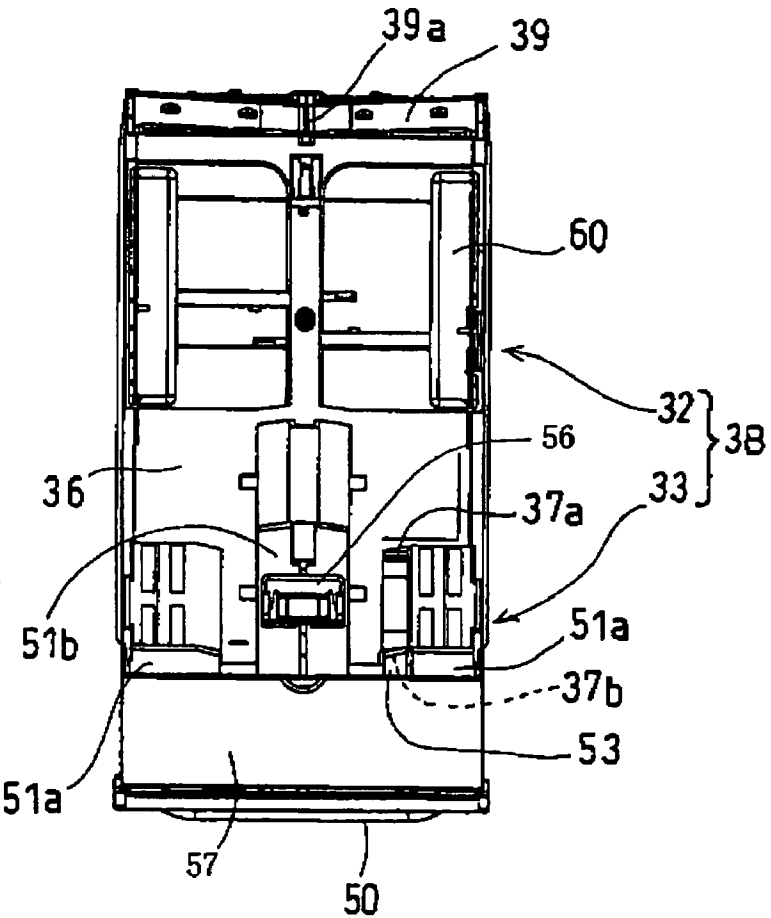
FIG. 7C is a plan view of the second sheet supply cassette in its longitudinally elongated state.
Figure 7B:
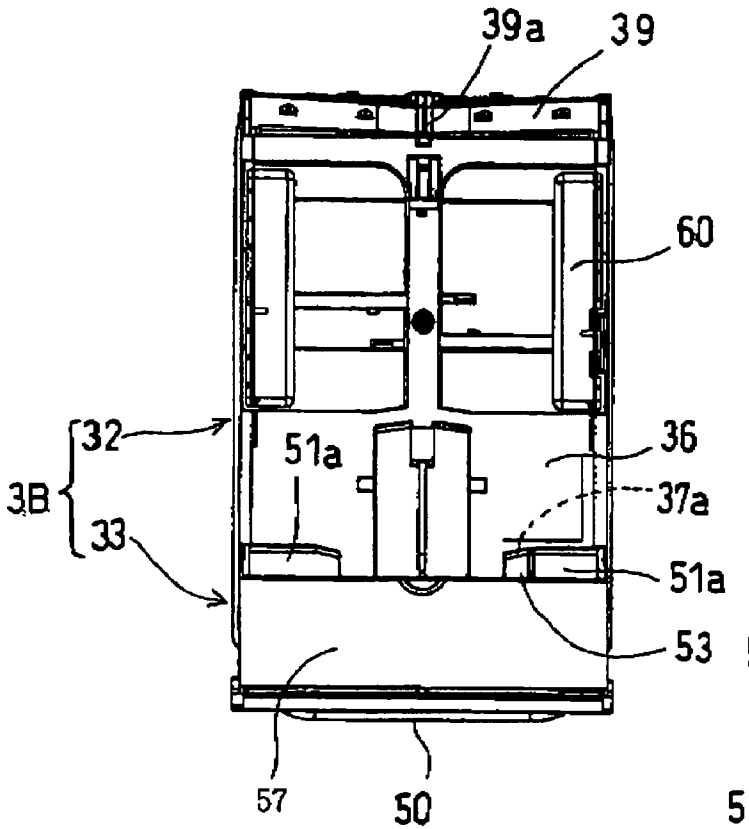
FIG. 7B is a plan view of the second sheet supply cassette in its longitudinally contracted state.

As shown in FIGS. 7A, 7B and 7C, the lower second sheet supply cassette 3B includes a main body 32 and a movable casing structure 33 which are open upwards and which cooperate with each other to accommodate the stack of cut sheets P. The movable casing structure 33 is located nearer to the front opening 21*a* of the second lower casing 21, to support the trailing end portion of the stack as seen in the feeding direction of the cut sheets P, that is, in the X-axis direction. The movable casing structure 33 is movable relative to the main body 32 in the X-axis direction, so that the second sheet supply cassette 3B is selectively placed in a longitudinally contracted state of FIG. 7B and a longitudinally elongated state of FIG. 7C. The main body 32 and movable casing structure 33 are both formed of a synthetic resin by injection molding. As shown in FIGS. 2 and 6, a second-path member 34 defining a second U-turn path which merges with the first U-turn path 27 is removably mounted on a cutout portion 35 formed at the rear end of the second lower casing 21. The second U-turn path extends through the rear end portions of the first and second lower casings 20, 21.

As also shown in FIG. 7A, the main body 32 consists of a bottom plate 36, two side plates 32*a*, 32*b* and a rear plate 32*c*. The rear plate 32*c* is provided on its inner surface with two first backing portions 41 and four second backing portions 40 which are spaced apart from each other in the Y-axis direction and which are provided to back an inclined sheet separator plate 39. These backing portions 40, 41 have a trapezoidal or substantially triangular shape. Each of the two second backing portions 40 located near the opposite end portions of the main body 32 as seen in the direction of width of the cut sheets P has a vertically extending T-slot. The sheet separator plate 39 formed of a synthetic resin by injection molding has two lugs 0032 integrally formed on its back surface. These lugs are T-shaped in cross section, so that the sheet separator plate 39 is attached to the back plate 32*c* by engagement of the lugs with the T-slots of the two second backing portions 40.

The sheet separator plate 39 is an elongate plate extending in the Y-axis direction (width direction of the cut sheets P), and has a window 45 formed in a longitudinally central portion, as shown in FIG. 6. The sheet separator plate 39 has a casing portion 46 integrally formed on its back surface at the longitudinally central portion having the window 45, as shown in FIG. 7A. This casing portion 46 cooperates with the window 45 to accommodate a saw-toothed elastic separator pad 39*a* (shown in FIGS. 7B and 7C) functioning as sheet separating means. The two first backing portions 41 have inclined front surfaces held in abutting contact with reinforcement ribs (not shown) which connect the right and left walls of the casing portion 46 and the adjacent portions of the back surface of the sheet separator plate 39. Accordingly, the longitudinally central portion of the sheet separator plate 39 corresponding to the widthwise central portion of the cut sheet P is convex toward the front end of the second sheet supply cassette 3B. The two longitudinal portions of the sheet separator plate 39 on the opposite sides of the central convex portion are inclined so as to be retracted toward the rear end of the first sheet supply cassette 3A (away from the leading edge of the cut sheets p) as they extend toward the respective opposite longitudinal ends in the longitudinal direction of the sheet separator plate 39. Thus, the sheet separator plate 39 has a convex shape in cross section taken in the horizontal plane.

Figure 7E:
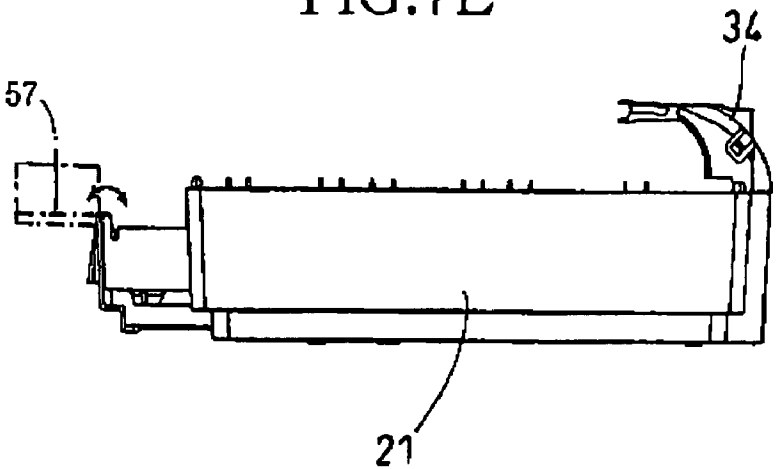
FIG. 7E is a cross sectional view taken along line 7E-7E of FIG. 7D.
Figure 7D:
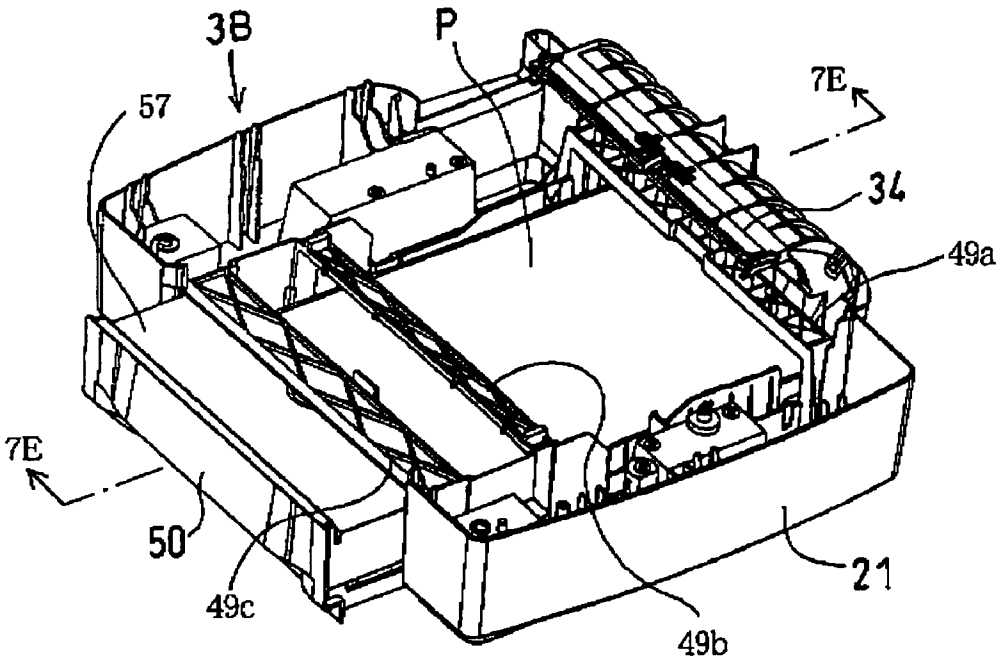
FIG. 7D is a perspective view of the second sheet supply cassette in its longitudinally elongated state installed in the second lower casing.

The second lower casing 21 accommodating the lower second sheet supply cassette 3B has a plurality of reinforcing beams 49*a*, 49*b* and 49*c* extending over the second sheet supply cassette 3B in the Y-axis direction (perpendicular to the feeding direction A of the cut sheets P), as shown in FIGS. 6 and 7D. The most downstream reinforcing beam 49*a* as seen in the feeding direction A has guide ribs 49*d* formed integrally on its underside such that the guide ribs 64 extend in the feeding direction A. These guide ribs 49*d* also function as reinforcing ribs.

The bottom plate 36 has a front recessed portion 36*a* (FIG. 2), which has a plurality of recesses (not shown) at a predetermined position in the Y-axis direction (width direction of the cut sheets P perpendicular to the feeding direction A). This position is offset from the center position of the front recessed portion 36*a* in the Y-axis direction, by a suitable distance in the left direction as viewed in FIG. 7A. The plurality of recesses are spaced from each other in the X-axis direction, and are provided to define respective X-axis positions of the movable casing structure 33 relative to the main body 32, which X-axis positions correspond to respective different lengths of the cut sheets P (in the feeding direction A).

As shown in FIGS. 2 and 7A-7D, the movable casing structure includes: a front wall 50 that can close the front opening 21*a* of the second lower casing 21; a pair of side support plates 51*a* and a pair of central support plates 51*b*, which extend from the lower part of the front wall 50 in the horizontal direction and which support the trailing end portion of the stack of cut sheets P; a planar operating portion 52*c* extending upright in opposed relation with the front wall 50, as shown in FIGS. 2 and 7A; and an elastic support plate 53 extending from the proximal end of the operating portion 52*c* in the feeding direction A of the cut sheets P toward the main body 32. The elastic support plate 53 has an engaging pawl 54 (shown in FIG. 2) integrally formed at its distal end such that the engaging pawl 54 extends downwards. The engaging pawl 54 is engageable with a selected one of two recesses 37*a*, 37*b* (shown in FIGS. 7B and 7C) formed in the front recessed portion 36*a* of the bottom plate 36 of the main body 32. As shown in FIG. 2, the movable casing structure 33 has a knob portion 55 formed outwardly of the front wall 50 such that the knob portion 55 and the front wall 50 cooperate to define a downwardly open void. The proximal end portions of the operating portion 52 and the elastic support plate 53 are formed integrally with a base which is an integral part of the front wall 50 and which is vertically elastically deformable. Namely, the elastic support plate 53 and the operating portion 52 are formed integrally with the front wall 50, and the engaging pawl 54 of the elastic support plate 53 is engageable with the selected recess 37*a*, 37*b* in the front recessed portion 36*a*, upon elastic deformation of the elastic support plate 53 by deflecting the operating portion 52, at the appropriate X-axis position of the movable casing structure 33, depending upon the length of the stack of cut sheets P to be accommodated in the second sheet supply cassette 3B.

The cut sheets P of the A4 size are stacked in the second sheet supply cassette 3B placed in its longitudinally contracted state of FIG. 7B. To change the second sheet supply cassette 3B from the longitudinally elongated state of FIG. 7C to the longitudinally contracted state of FIG. 7B, the operating portion 52 is deflected by the user, so as to shorten the spacing distance between the upper end of the operating portion 52 and the inner surface of the front wall 50, so that the elastic support plate 53 is deflected such that the free end portion having the engaging pawl 54 is moved upwards. In this state, the movable casing structure 33 is pushed at its front wall 50 in the rearward direction, until the pawl 54 is disengaged from the upward recess 37*b*. Then, the operating force is released from the operating portion 52 and the movable casing structure 33 is further moved rearwards until the longitudinally contracted state of FIG. 7B is established, that is, until the pawl 54 is brought into engagement with the downward recess 37*a*. In this contracted state, the lid 57 in its closed state is accommodated within the second sheet supply cassette 3B and is not visible, as shown in FIGS. 1 and 7B.

When the cut sheets P of the legal size larger than the A4 size are stacked in the second sheet supply cassette 3B, the operating portion 52 is deflected to disengage the pawl 54 from the downstream recess 37*a*, and the movable casing structure 33 is pulled forwards until the longitudinally elongated state of FIG. 7C is established, that is, until the pawl 54 is brought into engagement with the upstream recess 37*b*. In this elongated state, the front end portion of the cassette 3B projects from the second lower casing 21, as shown in FIGS. 7D and 7E. When the lid 57 is in its closed state, the front end portion of the stacked cut sheets P located outside the second lower casing 21 is covered by the lid 57 and protected from exposure to a foreign matter such as dust and dirt.

The front wall 50 is provided at its upper end with a pivotally supported lid 57 which covers the front end portion of the movable casing structure 33 when the lid 57 is in its closed position, as shown in FIGS. 7B-7E. The length of this lid 57 in the sheet feeding direction is large enough to cover the maximum distance of movement of the movable casing structure 33.

The side support plates 51*a*, central support plates 51*b* and elastic support plate 53 of the movable casing structure 33 are received within the depth of the front recessed portion 36*a* of the main body 32, such that the upper surfaces of those support plates 51*a*, 51*b*, 53 are flush with the upper surface of the bottom plate 36, so that the stack of cut sheets P accommodated in the second sheet supply cassette 3B is supported at its bottom surface in a plane defined by the upper surfaces of the support plates 51*a*, 51*b*, 53.

On the central support plate 51*b*, there is slidably mounted a trailing-edge stop 56 for abutting contact with the trailing edge of the stack of cut sheets P to position the stack in the sheet feeding direction A, that is, in the X-axis direction. The trailing-edge stop 56 is movable in the X-axis direction such that the stop 56 is moved in steps and stopped at a selected one of positions in the X-axis direction. In a pair of second recessed portions 36*b* of the bottom plate 36, there are disposed two widthwise stops 60 for abutting contact with the respective opposite side edges of the stack The two widthwise stops 60 are movable in the width direction of the cut sheets P, that is, in the Y-axis direction, to center the stack in the second sheet supply cassette 3B in the Y-axis direction.

The movable casing structure 33 has an integrally formed support leg portion 62 (shown in FIG. 2) which supports the side support plates 51*a*, central support plate 51*b* and elastic support plate 53 such that the upper surface of these support plates 51*a*, 51*b*, 53 are flush with the upper surface of the bottom plate 36 of the main body 32, irrespective of the position of the movable casing structure 33 in the X-axis direction. This arrangement assures freedom of the stack of cut sheets P from creasing or bending due to different levels of the above-indicated upper surfaces.

The first sheet feeding device 6 and the second sheet feeding device 65 will be described by reference to FIGS. 2-4 and 8-12. As described above, the first sheet feeding device 6 includes the roller support arm 6*a* in the form of a frame structure formed of a synthetic resin. The roller support arm 6*a* rotatably supports at its lower or free end portion the sheet supply roller 6*b*, which has an outermost layer formed of a rubber material, elastomer, EPDM or any other material having a high coefficient of friction. The outermost layer has a knurled outer surface. The roller support arm 6*a* rotatably supports at its upper or proximal end portion an end portion of a drive shaft 74 also formed of a synthetic resin. The first sheet feeding device 6 further includes a gear transmission mechanism 6*c* in the form of a gear train disposed within the roller support arm 6*a*. A rotary motion of the drive shaft 74 is transmitted to the sheet supply roller 6*b* through the gear transmission mechanism 6*c*, for rotating the sheet supply roller 6*b* in the predetermined direction. The gear transmission mechanism 6*c* includes: a gear rotated with the drive shaft 74; a planetary gear which is supported by an end portion of a carrier arm and which meshes with the gear rotated with the drive shaft 74; and three intermediate gears transmitting a rotary motion of the planetary gear to a gear rotated with the sheet supply roller 6*b*.

Figure 8:
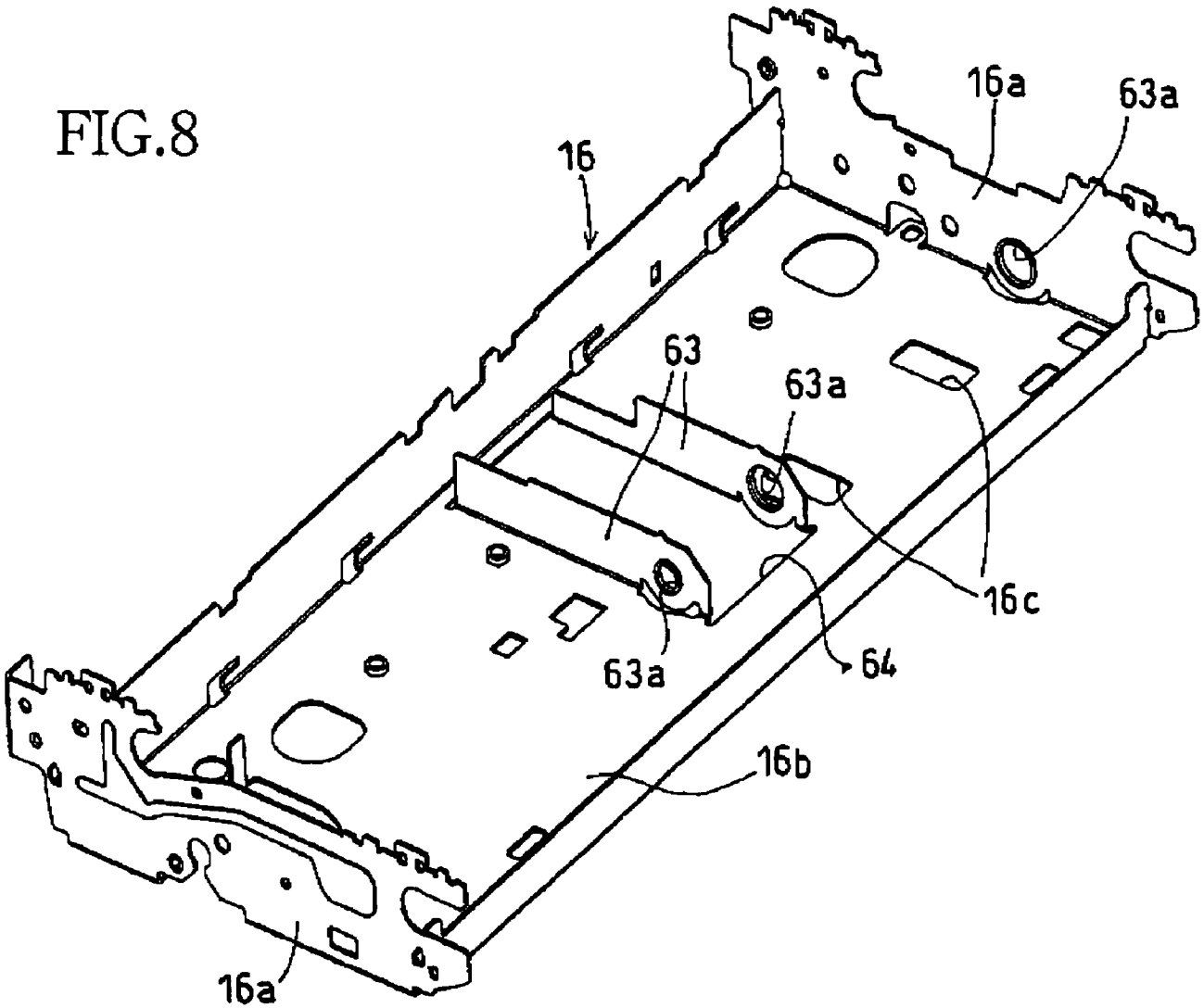
FIG. 8 is a perspective view of a main frame of the image-recording apparatus.

As shown in FIG. 8, the main frame 16 has a pair of shaft support plates 63 extending upright from the bottom plate 16*b* and opposed to each other in the axial direction of the drive shaft 74, and the bottom plate 16*b* has an aperture 64 that is formed therethrough between these two shaft support plates 63, as a result of formation of the shaft support plates 62. The shaft support plates 63 and one of the two side plates 16*a* have respective shaft holes 63*a* through which the drive shaft 74 is inserted such that the drive shaft 74 is freely rotatable relative to the shaft support plates 63 and the side plate 16*a*. The above-indicated end portion of the drive shaft 74 extends through the proximal end portion of the roller support arm 6*a* such that the axis of the drive shaft 74 is parallel to the axes of the gears of the gear transmission mechanism 6*c*. The roller support arm 6*a* extends through the aperture 64, as shown in FIG. 4. Thus, the roller support arm 6*a* and the drive shaft 74 are supported by the shaft holes 63*a* of the pair of shaft support plates 63 such that the roller support arm 6*a* is pivotable about the axis of rotation of the drive shaft 74 and such that the drive shaft 74 is rotatable relative to the shaft support plates 63. The roller support arm 6*a* is biased downwards by a suitable biasing device such as a torsion spring such that the sheet supply roller 6*b* is normally held in a position of FIG. 4 below the bottom plate 16*b*.

When the first sheet supply cassette 3A is inserted into or removed from the first lower casing 20 of the housing 2, the roller support arm 6*a* is automatically pivoted so as to move the sheet supply roller 6*b* upwards or downwards. There will be described a mechanism for this automatic pivotal movements of the roller support arm 6*a*. This mechanism includes a generally planar cam follower 75 (shown in FIG. 5) which is firmed of a synthetic resin and which extends from the roller support arm 6*a* in the axial direction of the drive shaft 74, below the bottom plate 16*b* of the main frame 16. The first sheet supply cassette 3A has a cam portion 77 formed on the upper part of a side plate 3*d*, and the end portion of the cam follower 75 remote from the roller support arm 6*a* is located above the cam portion 77, as shown in FIG. 5. The cam follower 75 has integrally formed bearings 76 which extend upwards through holes 16*c* (shown in FIG. 8) formed through the bottom plate 16*b*. The bearings 76 have bearing portions fitted on the drive shaft 74 such that the bearing portions are rotatable relative to the drive shaft 74. The cam follower 75 is substantially parallel and located close to the lower surface of the bottom plate 16*b* when a most part of the sheet supply roller 6*b* is located above the bottom plate 16*b* as a result of an upward movement of the sheet supply roller 6*b* through the aperture 64.

According to the above-described mechanism for automatic pivotal movements of the roller support arm 6*a* upon installation and removal of the first sheet supply cassette 3A, a movement of the first sheet supply cassette 3A through the front opening 20*a* into the first lower casing 20 causes the cam portion 77 to come into abutting contact with the lower surface of the cam follower 75. As the first sheet supply cassette 3A is moved into the first lower casing 20, the cam portion 77 pivots the cam follower 75 and the roller support arm 6*a* in the upward direction about the axis of the drive shaft 74, so that the sheet supply roller 6*b* is moved up through the aperture 74 to an elevated position above the top face of the sheet separator plate 8. In this elevated position, the sheet supply roller 6*b* is accommodated in a space above the bottom plate 16*b* (within the main frame 16), while the generally planar cam follower 75 is in contact or proximity with the lower surface of the bottom plate 16*b*. Thus, the present mechanism permits upward and downward pivotal movements of the roller support arm 6*a* to permit the installation and removal of the first sheet supply cassette 3A, without having to provide a large clearance between the bottom plate 16*b* of the main frame 16 and the first sheet supply cassette 3A.

When the first sheet supply cassette 3A has been moved all the way into the first lower casing 20, the cam follower 76 clears the uppermost part of the cam portion 77 and moves into contact with a recessed part of the cam portion 77, so that the roller support arm 6*a* which is biased downwards is permitted to be pivoted downwards, with a result of a downward movement of the sheet supply roller 6*b* to a lowered position in which the sheet supply roller 6*b* is held in contact with the uppermost cut sheet P of the stack accommodated in the storage portion 31.

The above-indicated recessed part of the cam portion 77 has a lowermost portion with which the cam follower 75 comes into contact under the biasing action of the biasing means biasing the roller support arm 6*a*, when the sheet supply roller 6*b* comes into abutting contact with a multiple-feed preventive portion 78 (shown in FIG. 4) of the bottom plate of the first sheet supply cassette 3A in the absence of the cut sheets P, while the cassette 3A is installed in position.

As described above, the first sheet feeding device 6 is provided with the cam follower 75 located below the bottom plate 16*b* of the main frame 16, while the first sheet supply cassette 3A is provided with the cam portion 77 which cooperates with the cam follower 75 to temporarily pivot the first sheet ceding device 6 (including the roller support arm 6*a*) in the upward and downward directions when the first sheet supply device 3A is moved into and removed from the housing 2 (first lower casing 20). The upward and downward pivotal movements of the first sheet feeding device 6 permit easy installation and removal of the first sheet supply device 3A.

Figure 10:
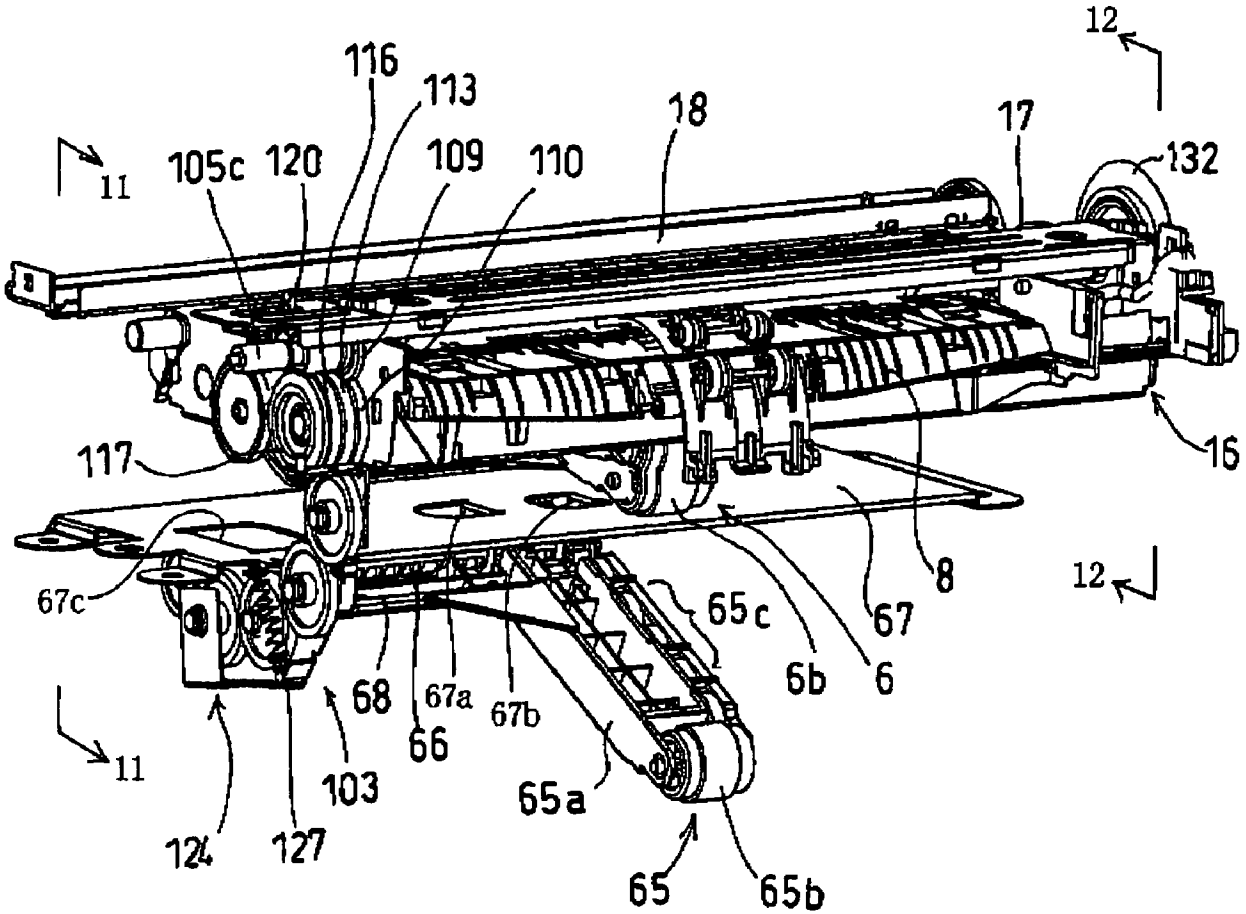
FIG. 10 is a rear-side perspective view showing a first sheet feeding device and a second sheet feeding device.
Figure 11:
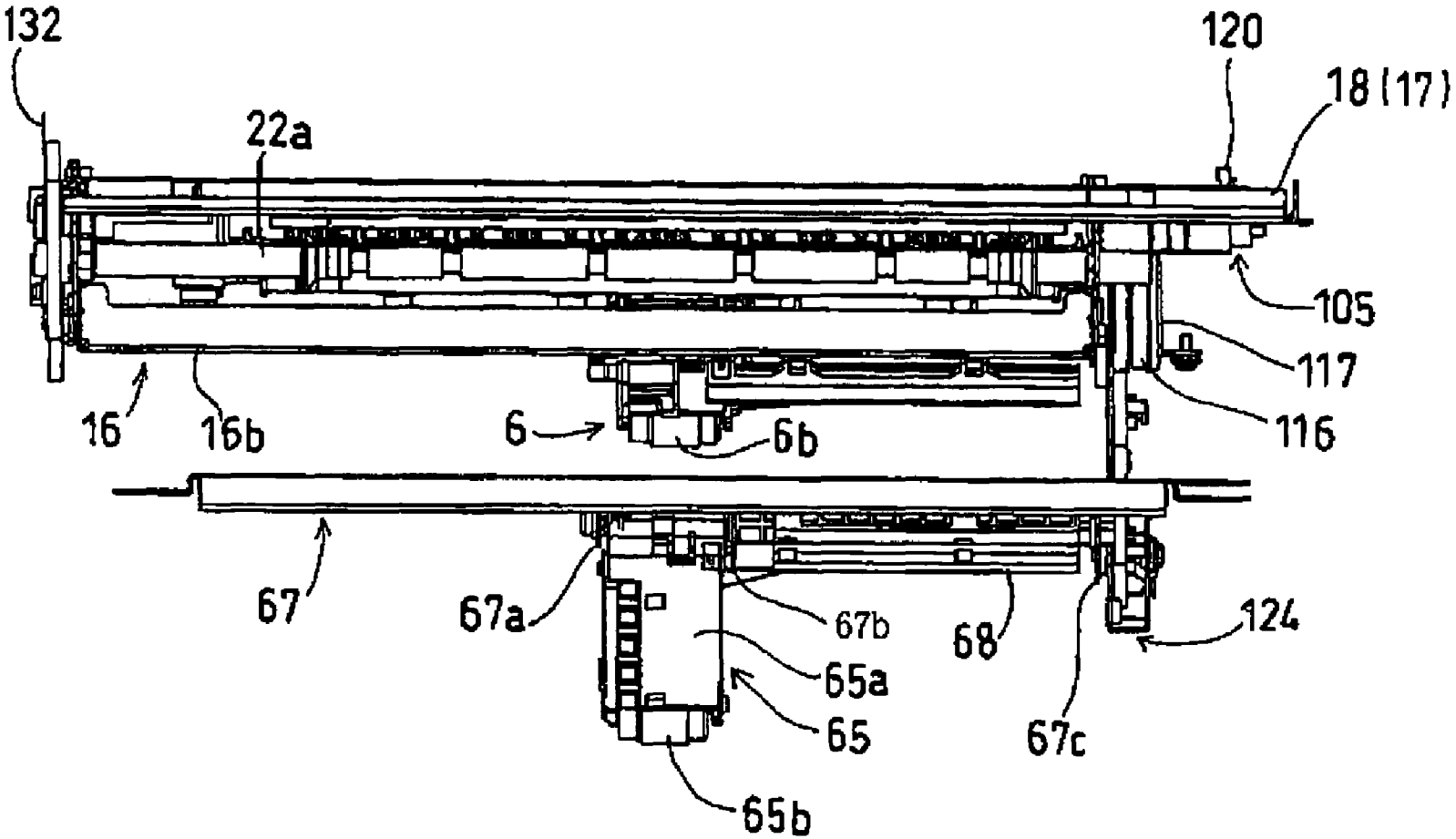
FIG. 11 is an elevational view taken along lines 11-11 of FIG. 10, showing the fist and second sheet feeding devices.

The second sheet supply cassette 3B has a sheet storage capacity of about 250 cut sheets P. The second sheet feeding device 65 for feeding the cut sheets P one after another from a stack in the second sheet supply cassette 3B is similar in construction to the first sheet feeding 6. As shown in FIGS. 2 and 10, the second sheet feeding device 65 includes a roller support arm 65*a* in the form of a frame structure formed of a synthetic resin. The roller support arm 65*a* rotatably supports at its lower or free end portion a rotary medium-supply member in the form of a sheet supply roller 65*b*, which has an outermost layer formed of a rubber material, elastomer, EPDM or any other material having a high coefficient of friction. The outermost layer has a knurled outer surface. The roller support arm 65*a* rotatably supports at its upper or proximal end portion an end portion of a drive shaft 66 also formed of a synthetic resin. The second sheet feeding device 65 further includes a gear transmission mechanism 65*c* in the form of a gear train disposed within the roller support arm 65*a*. A rotary motion of the drive shaft 66 is transmitted to the sheet supply roller 65*b* through the gear transmission mechanism 65*c*, for rotating the sheet supply roller 65*b* in the predetermined direction. The gear transmission mechanism 65*c* includes: a gear rotated with the drive shaft 66; a planetary gear which is supported by an end portion of a carrier arm and which meshes with the gear rotated with the drive shaft 66; and three intermediate gears transmitting a rotary motion of the planetary gear to a gear rotated with the sheet supply roller 65*b*.

The second lower casing 21 has a pair of mounts 21*b* on its right and left sides, as shown in FIG. 6, and a planar support frame 67 which is fixed to the mounts 21*b* and which is located below the main frame 16, as shown in FIGS. 2 and 10-12. The support frame 67 has three shaft support plates 67*a*, 67*b* and 67*c* (shown in FIG. 12) which have respective shaft holes 142 (shown in FIG. 21) through which the drive shaft 66 is inserted such that the drive shaft 66 is freely rotatable relative to the shaft support plates 67*a*, 67*b*, 67*c*. The above-indicated end portion of the drive shaft 66 extends through the proximal end portion of the roller support arm 65*a* such that the axis of the drive shaft 66 is parallel to the axes of the gears of the gear transmission mechanism 65*c*. The roller support arm 65*a* is biased downwards by a biasing device, as described below in detail by reference to FIGS. 18-21, such that the sheet supply roller 65*b* is normally held in contact with a stack of cut sheets P in the second sheet supply cassette 3B.

Figure 12:
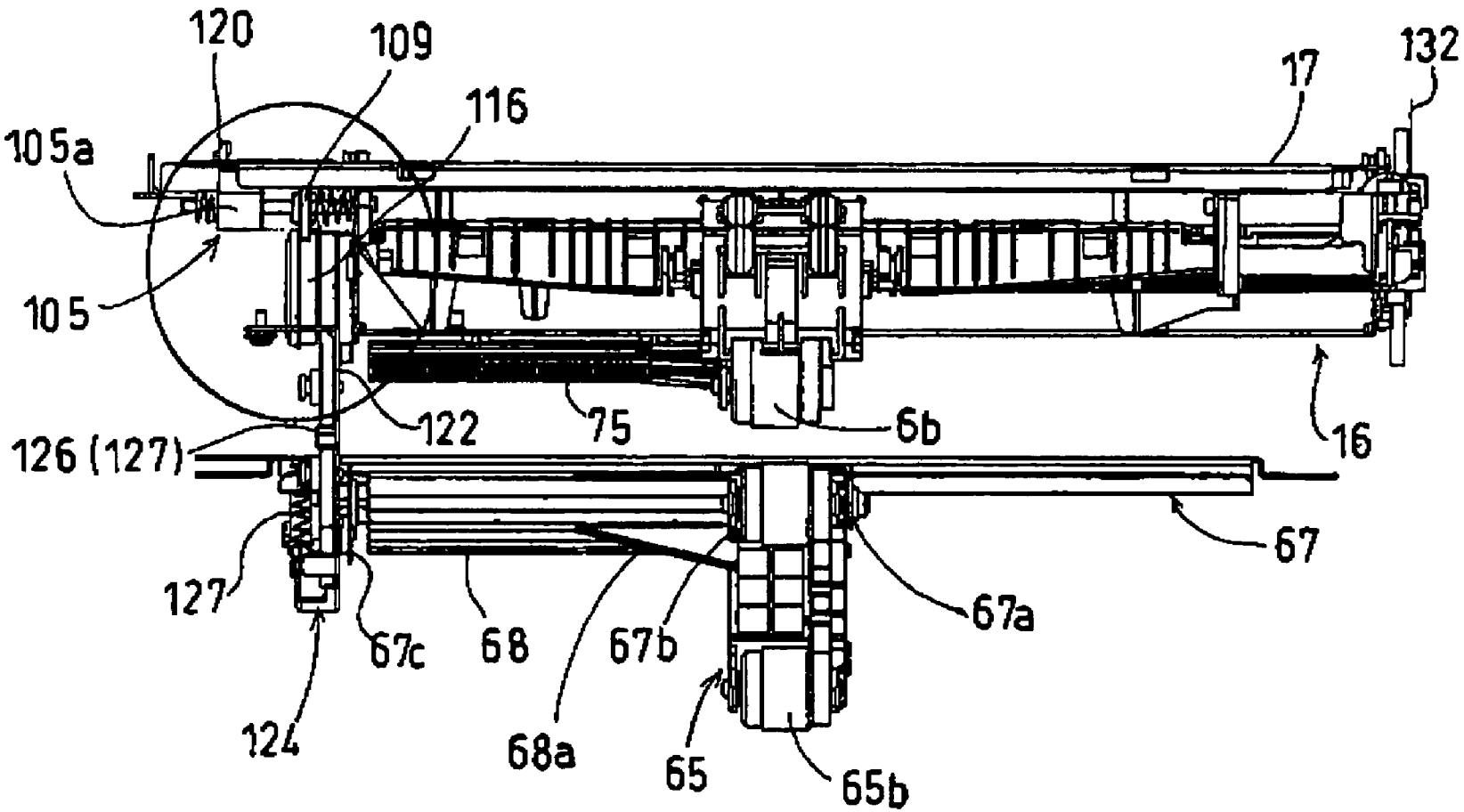
FIG. 12 is an elevational view taken along lines 12-12 of FIG. 10, showing the first and second sheet feeding devices.

A mechanism for automatic pivotal movements of the roller support arm 65*a* upon installation and removal of the second sheet supply cassette 3B into and remove the second lower casing 21 is similar in construction to the mechanism for the roller support arm 6*a* and the first sheet supply cassette 3A. This mechanism includes a generally planar cam follower 68 (shown in FIGS. 10-12) which is formed of a synthetic resin and which extends from the roller support arm 65*a* in the axial direction of the drive shaft 66, below the support frame 67. The second sheet supply cassette 3B has a cam portion 60*a* (shown in FIG. 7) formed on the upper part of one of the side plates 60, and the end portion of the cam follower 68 remote from the roller support arm 65*a* is located above the cam portion 60*a* The cam follower 68 has integrally formed bearings 69 (shown in FIG. 6) fitted on the drive shaft 66 such that the bearings 69 are rotatable relative to the drive shaft 66. The roller support arm 65*a* and the cam follower 68 are substantially parallel and located close to the lower surface of the support plate 67 when the stack of cut sheets P accommodated in the second sheet supply cassette 3B has a relatively large height as shown in FIG. 2. The cam follower 68 and the roller support arm 65*a* are formed with a reinforcing triangular rib 68*a* formed therebetween, as shown in FIG. 12.

Figure 9:
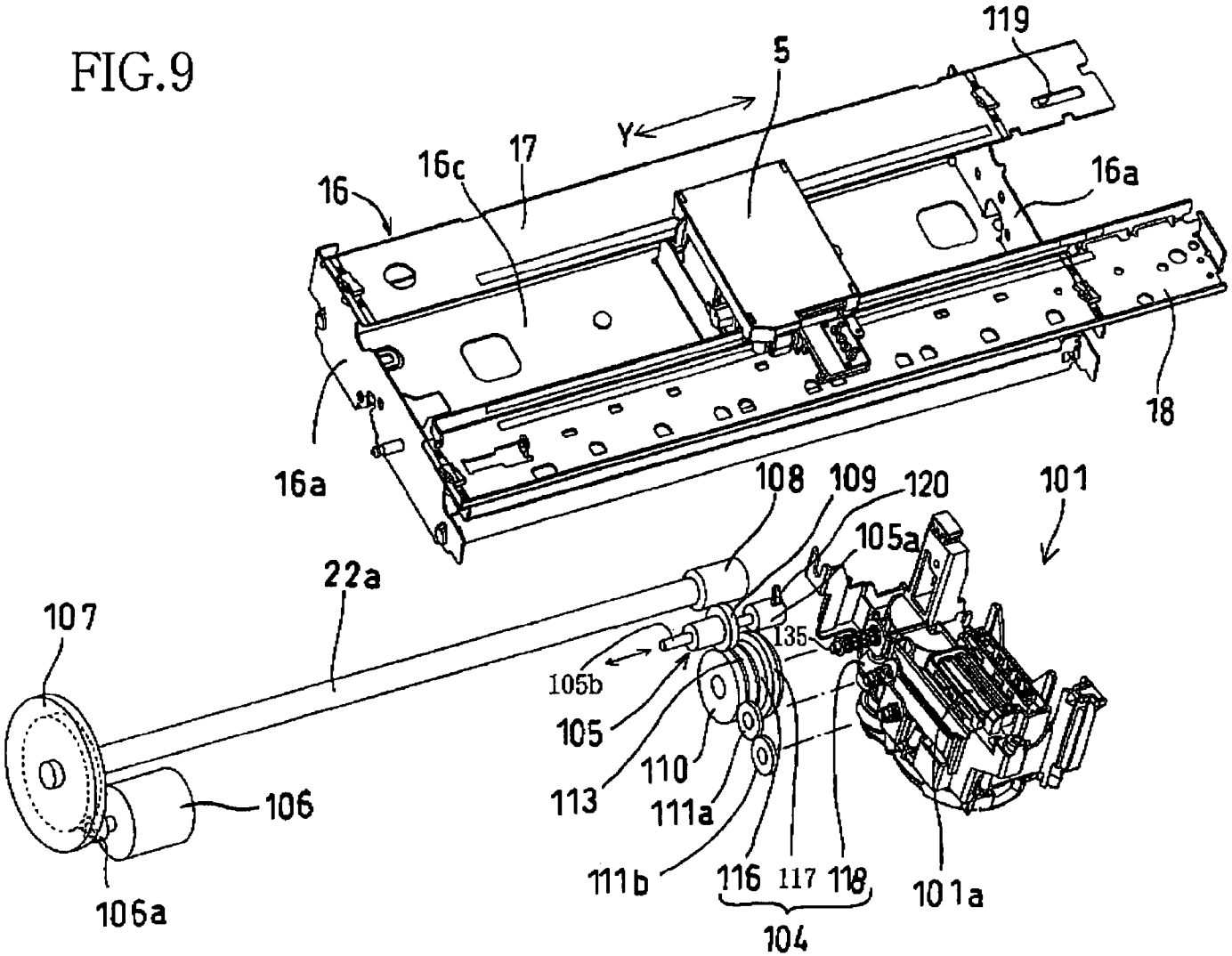
FIG. 9 is a perspective view showing a carriage, a guide member, a maintenance unit and a power-transmission switching device of the apparatus.

Referring to FIGS. 6 and 9-15, there will be described power transmitting portions 102, 103 and 104 arranged to transmit a drive force to the first and second sheet feeding devices 6, 65 and the maintenance unit 101. On a left end part of the lower surface of the downstream or second guide member 18 of the main frame 16 as seen in FIG. 9, there is mounted a bidirectionally operable sheet feeding motor 106. A rotary motion of this sheet feeding motor 106 is transmitted to a speed reduction gear 107 fixed to the left end portion of the shaft of the registering roller 22*a*, through a pinion 106*a* fixed to the drive shaft of the motor 106. To the right end portion of the shaft of the registering roller 22*a*, a drive gear 108 in the form of an output spur gear is fixed for rotation with the registering roller 22*a*. The drive gear 108 functions as a part of a drive-force output device (106-108, 22*a*) operable to produce a drive force for rotating the sheet supply rollers 6*b*, 65*b* and registering roller 22*a*. This drive gear 108 meshes with an intermediate gear in the form of a shift gear 109 of a power-transmission switching device 105. The shift gear 109 is shiftable or slidable in the axial direction of the registering roller 22*a*. The power-transmission switching device 105 is arranged to transmit the rotary drive force or motion of the drive gear 108 selectively to one of the first power transmitting portion 102 for the first sheet feeding device 6, the second power transmitting portion 103 for the second sheet feeding device 65, and the third power transmitting portion 104 for the maintenance unit 101.

Figure 14C:
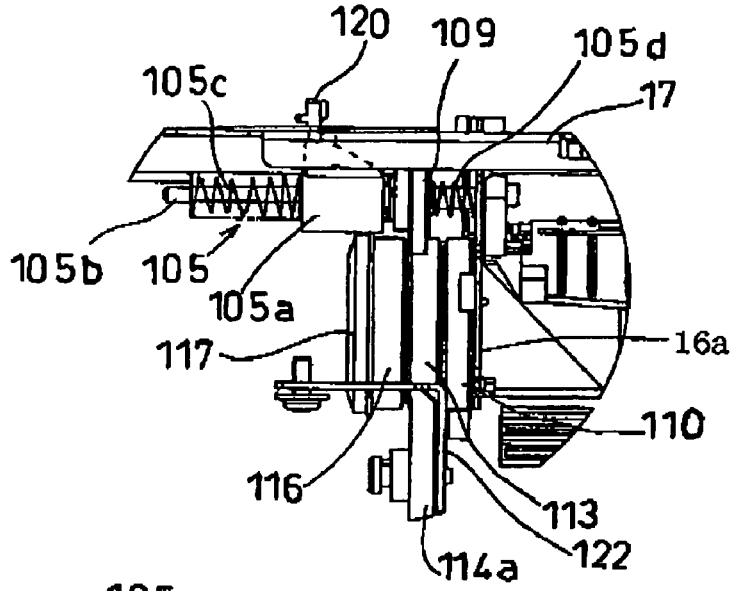
FIG. 14C is an enlarged cross sectional view showing the shift gear 109 and a second input spur gear 113 in meshing engagement with each other.
Figure 14B:
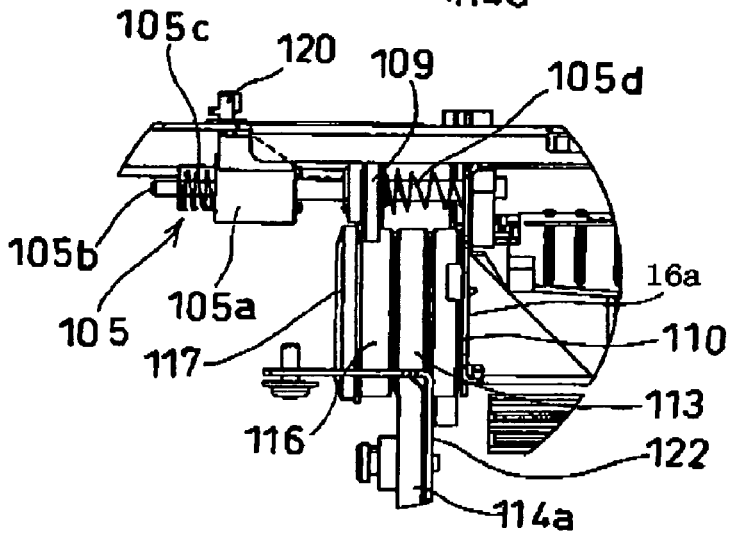
FIG. 14B is an enlarged cross sectional view showing the shift gear 109 and a third input spur gear 116 in meshing engagement with each other.
Figure 14A:
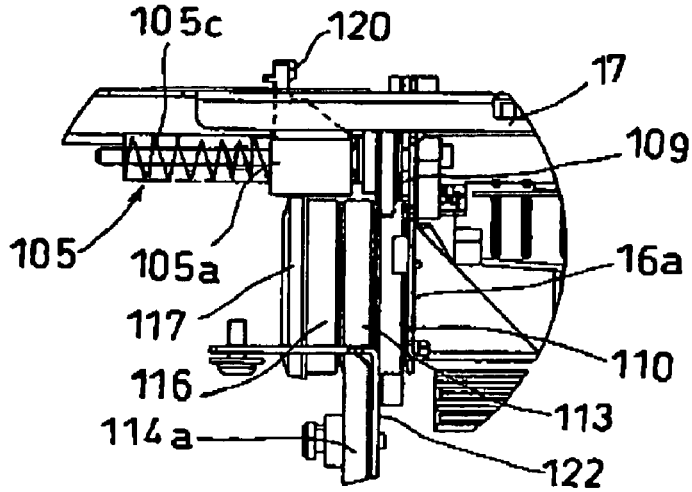
FIG. 14A is an enlarged cross sectional view showing a shift gear 109 and a first input spur gear 110 in meshing engagement with each other.

As shown in FIGS. 14A, 14B and 14C, the power-transmission switching device 105 includes: a support shaft 105*b* extending from right side plate 16*a* of the main frame 16 on the side of the maintenance unit 101, in a direction away from the left side plate 16*a*, in parallel with the lower surface of the first guide member 17; a block 105*a* slidably mounted on the support shaft 105*b*; the above-described shift gear 109 mounted on the support shaft 105*b* slidably toward and away from the block 105*a*; an abutting portion 120 formed integrally with the block 105*a* and extending upwards from the block 105*a*; a first biasing spring 105*c* biasing the block 105*a* leftwards toward the outer surface of the above-indicated right side plate 16*a*; and a second biasing spring 105*d* interposed between the above-indicated right side plate 16*a* and the shift gear 108 and biasing the shift gear 109 rightwards toward the block 105*a*. The biasing force of the second biasing spring 105*d* is smaller than that of the first biasing spring 105*c*.

The first, second and third power transmitting portions 102-104 are located outside and to the right of the recording area L (indicated in FIG. 3) in the main scanning direction or Y-axis direction, and the first power transmitting portion 102 is located nearest to the recording area L, and the third power transmitting portion 104 is located furthest from the recording area L, while the second power transmitting portion 103 is located intermediate between the first and third power transmitting portions 102, 104. The first power transmitting portion 102 is arranged to transmit a rotary motion of the shift gear 109 (drive force generated by the sheet feeding motor 106) to a driven gear 112 fixed to one end of the drive shaft 74 through a first input spur gear 110 and two intermediate gears 111*a*, 111*b*, when the shift gear 109 is in meshing engagement with the spur gear 110, as shown in FIGS. 5, 6, 9 and 13A.

Figure 13A:
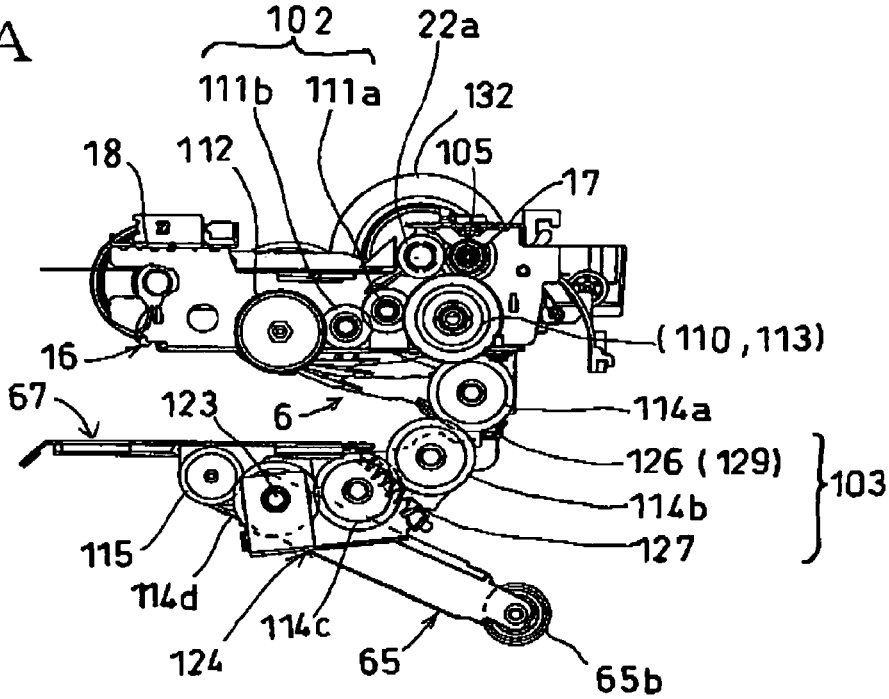
FIG. 13A is a side elevational view showing a second power transmitting portion when intermediate gears 114*a*, 114*b* of the second power transmitting portion are held in meshing engagement with each other, with the first lower casing being placed on the second lower casing.
Figure 13B:
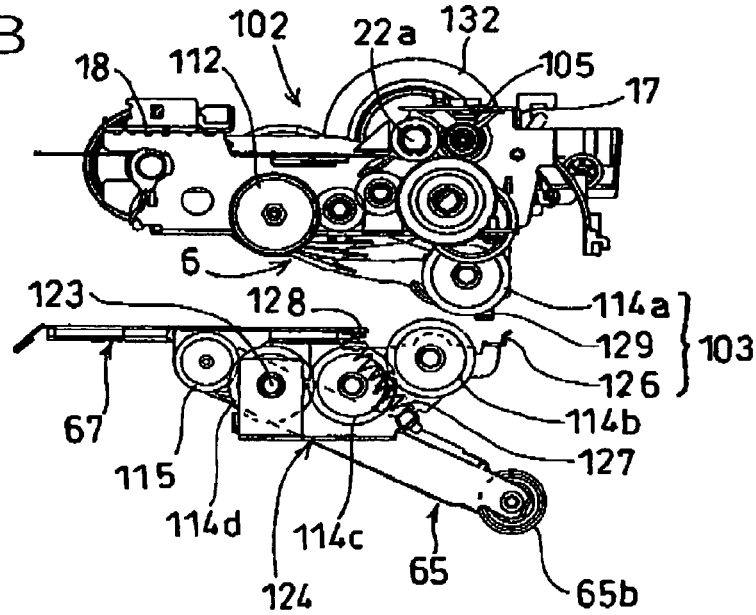
FIG. 13B is a side elevational view of the second power transmitting portion when the intermediate gears 114*a*, 114*b* are not in meshing engagement with each other, with the first and second lower casings being spaced from each other.

The second power transmitting portion 103 is arranged to transmit the rotary motion of the shift gear 109 to a driven gear 115 fixed to one end of the drive shaft 66 through a second input spur gear 113 and four intermediate gears 114*a*-114*d*, when the shift gear 109 is in meshing engagement with the spur gear 113, as shown in FIGS. 13A and 13B.

The third power transmitting portion 104 is arranged to transmit the rotary motion of the shift gear 109 to a power input portion (not shown) of the maintenance unit 101 through a third input spur gear 116, a large-diameter bevel gear 117 and a small-diameter bevel gear 118, as shown in FIG. 9. These bevel gears 117, 118 are held in meshing engagement with each other. The third input spur gear 116 and the large-diameter bevel gear 117 are formed integrally with each other, and the second input spur gear 113 is interposed between the first input spur gear 110 and the third input spur gear 116. These input spur gears 110, 113 and 116 are rotatably supported by a single shaft 135 such that the spur gears 110, 113 and 116 are rotatable relative to and independently of each other.

As described above, the abutting portion 120 of the power-transmission switching device 105 is formed integrally with the block 105*a* which is slidable relative to the shift gear 109. This abutting portion 120 extends upwards through an elongate slot 119 (shown in FIGS. 3, 9 and 14A-14C) formed through the right end portion of the upstream first guide member 17 of the main frame 16. On the other hand, the carriage 5 has a protrusion 121 formed on one end face thereof on the upstream side as seen in the sheet feeding direction A, as shown in FIG. 3. When the carriage 5 is moved rightwards as seen in FIG. 3 until the protrusion 121 is moved beyond the right side plate 16*a*, the protrusion 121 comes into contact with the abutting portion 120, thereby moving the power-transmission switching device 105 (block 105*a*, support shaft 105*b* and shift gear 109) in the right direction against the biasing force of the first biasing spring 105*c*, with a result of a rightward movement of the shift gear 109, permitting a rotary drive force or motion to be transmitted from the drive gear 108 selectively to the first, second and third input spur gears 110, 113, 116 through the shift gear 109, according to the distance of rightward movement of the carriage 5, more precisely, of the protrusion 121 from the right end of the recording area L. In this respect, it is noted that the shift gear 109 is smoothly slidable on the support shaft 105*b* in sliding contact with the spur gears 108, 110, 113, 116, for selective engagement with the spur gears 110, 113, 116, since all of the output gear in the firm of the drive gear 108, the intermediate gear in the form of the shift gear 109, and the input spur gears 110, 113, 116 are spur gears having the same pitch and tooth profile.

Before the protrusion 121 of the carriage 5 comes into abutting contact with the abutting portion 120, the abutting portion 120 is stopped at a first position by abutting contact with one end of the elongate slot 119 on the side of the right side plate 16*a* under the biasing force of the first biasing spring 105*c* which biases the block 105*a* and the shift gear 109 against the outer surface of the right side plate 16*a* via the second biasing spring 105*d*, since the biasing force of the first biasing spring 105*c* is larger than that of the second biasing spring 105*d*. In this state, the shift gear 109 is held in meshing engagement with the first input spur gear 110, as shown in FIG. 14A, so that the rotary motion of the sheet feeding motor 106 is transmitted to the drive shaft 74 of the first sheet feeding device 6 through the intermediate gears 111*a*, 111*b* and driven gear 112, whereby the sheet supply roller 6*b* is rotated by the sheet ceding motor 106.

When the abutting portion 120 is moved rightwards (as seen in FIG. 9) to a second position by the protrusion 121 of the carriage 5, the block 105*a* is moved against the biasing force of the first biasing spring 105*c*, so that the shift gear 109 is permitted to be shifted into meshing engagement with the second input spur gear 113, by the biasing force of the second biasing spring 105*d*, as shown in FIG. 14C, whereby the rotary motion of the sheet feeding motor 106 is transmitted to the drive shaft 66 of the second sheet feeding device 65 through the intermediate gears 114*a*-114*d* and driven gear 115. In FIGS. 14A-14C, the right and left sides are reversed with respect to the right and left sides as seen in FIG. 9.

When the carriage 5 is moved further rightwards to the predetermined standby position (moat distant from the right end of the recording area L) for operation of the maintenance unit 101, the abutting portion 120 is moved to a third position, and the block 105*a* is moved rightwards against the first biasing spring 105*c*, so that the shift gear 109 is permitted to be shifted rightwards by the biasing force of the second biasing spring 105*d*, into meshing engagement with the third input spur gear 116, as shown in FIG. 14B. This rightward movement of the shift gear 109 by the biasing force of the spring 105*d* relative to the spur gear 116 is stopped by abutting contact of the shift gear 109 with a radially outer portion of the large-diameter bevel gear 117 the outside diameter of which is larger than that of the spur gear 116. Even if the abutting portion 120 is further moved rightwards from the third position together with the carriage 5, only the block 105*a* is moved rightwards while the shift gear 109 remains stationary. In the third position of the abutting portion 120, the rotary motion of the sheet feeding motor 106 is transmitted to the power input portion of the maintenance unit 101 through the first and second bevel gears 117, 118, to operate a purging pump and other components (e.g., a mechanism to vertically move the cap portion 101*a*) incorporated in the maintenance unit 101.

Figure 15:
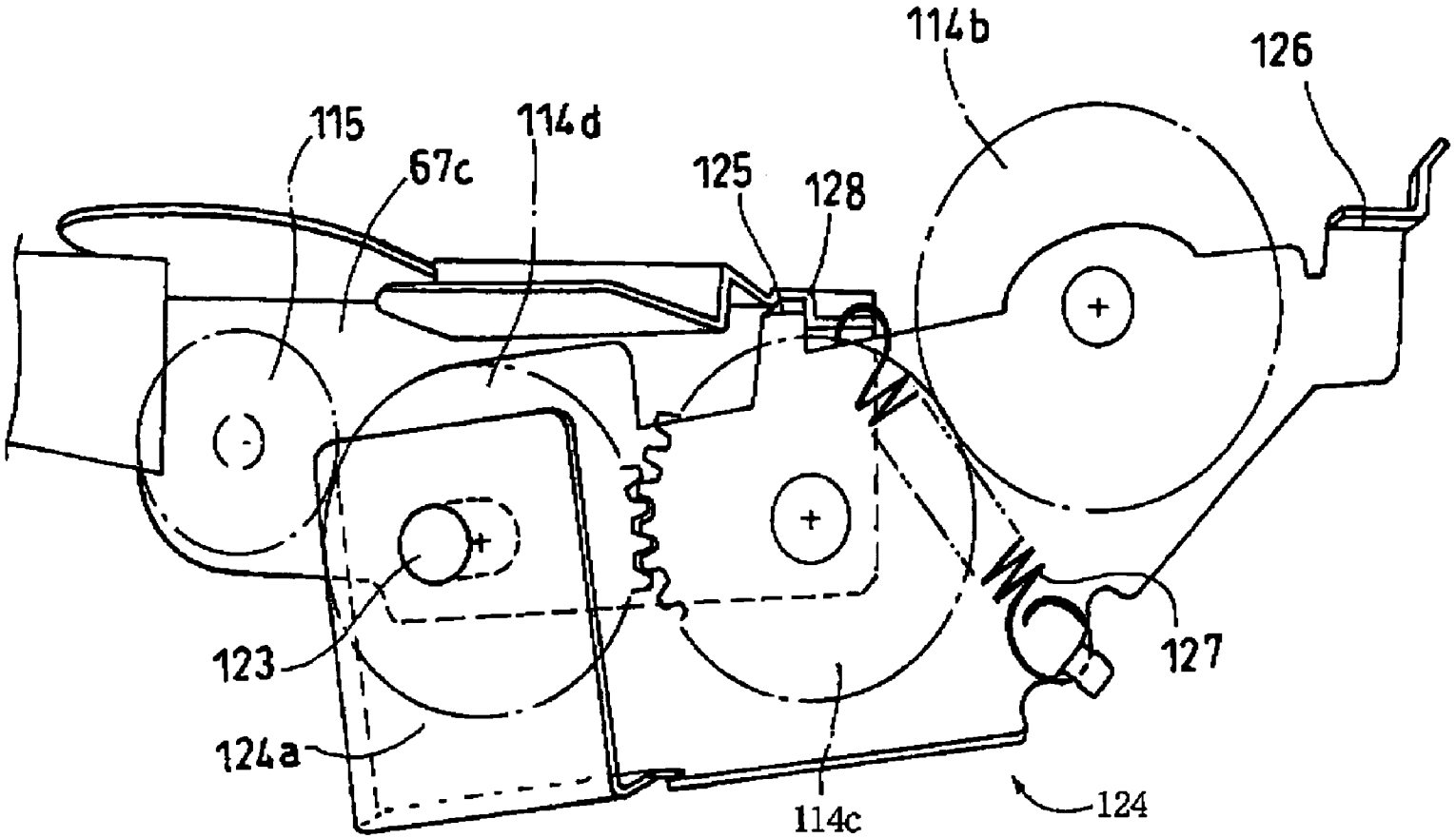
FIG. 15 is a side perspective view of the second power transmission portion.

The intermediate gear 114*a* meshing with the second input spur gear 113 of the second power transmitting portion 103 for the second sheet ceding device 65 is rotatably supported by a shaft attached to an L-shaped support plate 122 fixed to the right side plate 16*a*, as shown in FIG. 14B. As shown in FIG. 15, the driven gear 115 of the second sheet feeding device 65, and the intermediate gear 114*d* meshing with the driven gear 115 are rotatably supported by respective shafts attached to the shaft support plate 67*c* of the support frame 67 (shown in FIG. 12) fixed to the second lower casing 21. These shafts include a horizontal shaft 123 which rotatably supports the intermediate shaft 114*d* and which extends from the shaft support plate 67*c*. The horizontal shaft 123 also pivotally supports a pivotal frame 124 which includes a U-shaped section 124*a* that is open upwards, as shown in FIG. 15. The pivotal frame 124 is pivotable about the horizontal axis of the horizontal shaft 123 which engages the U-shaped section 124*a*. The intermediate gear 114*d* is interposed between two arms of the U-shaped section 124*a*. The pivotal frame 124 rotatably supports the intermediate gears 114*b* and 114*c*, and farther includes first and second stopper pieces 125 and 126, which are formed by bending integrally with the pivotal frame 124. The first stopper piece 125 is nearer to the axis of the horizontal shaft 123 than the second stopper piece 126, and is located radially outwardly of the intermediate gear 114*c*, while the second stopper piece 126 is more distance from the axis of the horizontal shaft 123. The shaft support plate 67*c* and the pivotal frame 124 are biased toward each other by a tensile spring 127, such that the pivotal frame 124 is biased in the counterclockwise direction as seen in FIG. 15. The shaft support plate 67*c* has a first abutting portion 128 for abutting contact with the first stopper piece 125, while the L-shaped support plate 122 has at its lower end a second abutting portion 129 for abutting contact with the second stopper piece 126, as shown in FIGS. 13A and 13B. The counterclockwise pivotal motion of the pivotal frame 124 by the biasing force of the tensile spring 127 is stopped by abutting contact of the stopper pieces 125, 126 with the respective abutting portions 128, 129.

When the first and second lower casings 20, 21 are spaced from each other, the intermediate gears 114*a* and 114*b* are not in meshing engagement with each other, as shown in FIG. 13B. In this state, however, the counterclockwise pivotal motion of the pivotal frame 124 under the biasing force of the tensile spring 127 is stopped by abutting contact of the first stopper piece 125 with the first abutting portion 128, thereby preventing otherwise possible undesirable collision of the teeth of the intermediate gear 114*c* with a horizontal portion of the support frame 67, and consequent damaging of the teeth.

When the first lower casing 20 is placed on the second lower casing 21, the intermediate gear 114*b* supported by the pivotal frame 124 is held in meshing engagement with the intermediate gear 114*a* supported by the first lower casing 20, as shown in FIG. 13A. In this state, the second stopper piece 126 is held in abutting contact with the second abutting portion 129, thereby stopping the counterclockwise pivotal motion of the pivotal frame 124, and preventing an otherwise possible excessively large amount of meshing engagement of the teeth of the intermediate gears 114*a*, 114*b*, and consequent overloading of these gears. Namely, the second stopper piece 126 and second abutting portion 129 assure an optimum amount of meshing engagement of the intermediate gears 114*a*, 114*b*.

Figure 16:
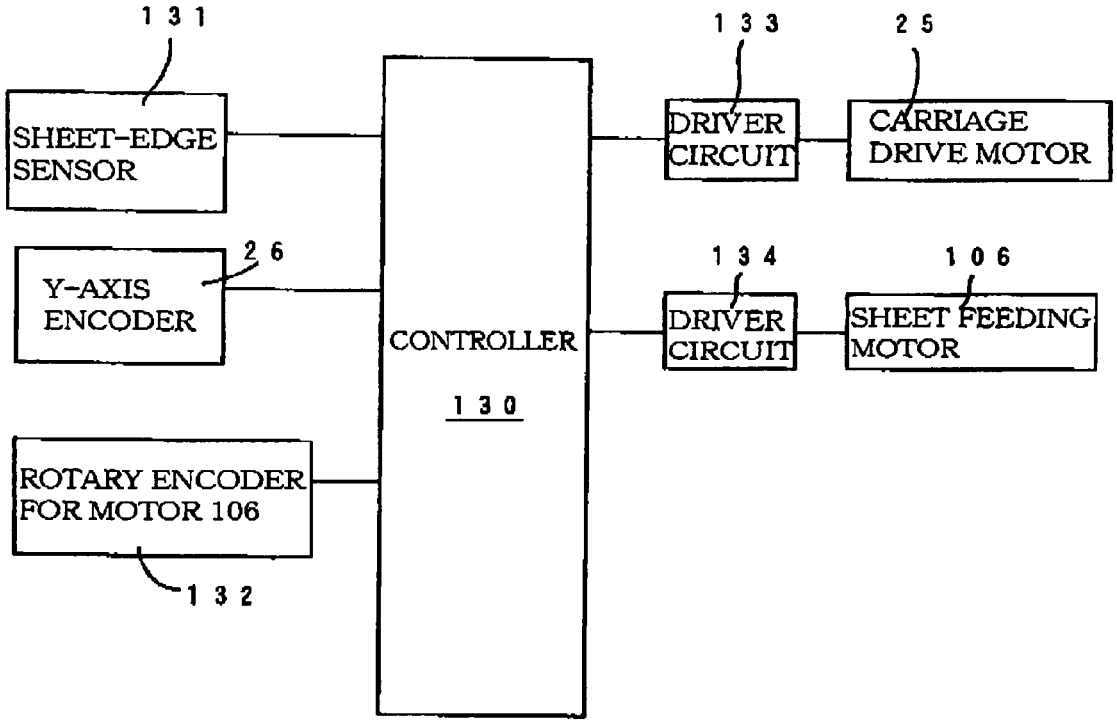
FIG. 16 is a functional block diagram of a control system.

Referring further to the block diagram of FIG. 15 and the flow chart of FIG. 16, there will be described a control system to control the operation of the image-recording apparatus 1, and a manner of controlling the power-transmission switching device 105 for selective transmission of the rotary drive force from the sheet feeding motor 106 (from the drive gear 108) to the first sheet feeding device 6, second sheet feeding device 65 and maintenance unit 101. As shown in FIG. 15, the control system includes a controller 130 principally constituted by a microcomputer, a sheet-edge sensor 181, the above-described Y-axis encoder 26, a rotary encoder 132 for detecting the rotating speed of the sheet feeding motor 106, a driver circuit 133 for the carriage drive motor 26, and a driver circuit for the sheet feeding motor 106. The sheet-edge sensor 131 is disposed upstream of the registering rollers 22*a*, 22*b* as seen in the sheet feeding direction A, namely, at a position near a point of merging of the first and second U-turn paths defined by the first-path and second-path members 27, 34, as shown in FIG. 4. The rotary encoder 132 for the sheet feeding motor 106 is fixed to one end of the registering roller 22*a* and rotated with the registering roller 22*a*, as shown in FIGS. 10-12, 13A and 13B.

Before power application to the image-recording apparatus 1, the carriage 5 is stopped at the predetermined standby position in which the lower surface of the recording head 4 in which the nozzles are open is in fluid-tight contact with the cap portion 101*a* exposed in the upper surface of the maintenance unit 101.

When the controller 130 receives an image-recording command from an external computer in step S2 of the flow chart of FIG. 15, for example, after power application to the image-recording apparatus 1 in step S1, the sheet feeding motor 106 is operated by a predetermined number of steps to lower the cap portion 101*a* away from the recording head 4 while the carriage 5 is located at the standby position Then, in step S3, the carriage drive motor 25 is operated in the forward direction to initiate a movement of the carriage 5 from the standby position to the flushing position right above the ink receiver 100. In the following step S4, a flushing operation of the recording head 4 is performed. The ink ejected from the nozzles of the recording head 4 during the flushing operation is stored in the ink receiver portion 100.

Then, the control flow goes to step S6 in which an inching operation of the sheet feeding motor 106 is performed to permit a smooth sliding movement of the shift gear 109 of the power-transmission switching device 105 by the first biasing spring 105*c*, from the position of meshing engagement of the shift gear 109 with the third input spur gear 116 shown in FIG. 14B to the position of engagement of the shift gear 109 with the first input spur gear 110 shown in FIG. 14A, via the position of meshing engagement of the shift gear 109 with the second input spur gear 113 shown in FIG. 14C. The inching operation of the motor 106 consists of one cycle or two cycles of a stepping operation of the motor 106 in the reverse direction by a predetermined angle smaller than an angle corresponding to the tooth pitch of the spur gears 109, 110, 113, 116 and a subsequent stepping operation of the motor 106 in the forward direction by the same predetermined angle.

Step S5 is followed by step S6 to determine whether the first sheet supply cassette 3A or the second sheet supply cassette 3B is presently selected. When the first sheet supply cassette 3A is selected, that is, when an affirmative decision (yes) is obtained in step S6, the shift gear 109 of the power-transmission device 105 remains in meshing engagement with the first input spur gear 110 as shown in FIG. 14A, without a movement of the carriage 5 toward the maintenance unit 101 for this meshing engagement. In this state, the sheet feeding motor 106 is operated in the reverse direction, in step S7, to rotate the sheet supply roller 6*b* in the forward direction through the first power transmitting portion 102, to feed the cut sheet P in the sheet feeding direction A.

During the operation of the sheet feeding motor 106 in the reverse direction, the uppermost cut sheet P of the stack is separated from the stack accommodated in the first sheet supply cassette 3A, and is fed in the sheet feeding direction A to a pressure nip between the registering rollers 22*a*, 22*b* through the position of the sheet-edge sensor 181. However, the cut sheet P is not fed toward the recording head 4, since the rotating directions of the registering rollers 22*a*, 22*b* during the reverse operation of the motor 106 do not permit the cut sheet P to be fed through the pressure nip between the rollers 22*a*, 22*b*. The reverse operation of the sheet feeding motor 106 is continued by a predetermined number of steps after the leading edge of the cut sheet P is detected by the sheet-edge sensor 131, that is, until the leading edge of the cut sheet P reaches the pressure nip between the registering rollers 22*a*, 22*b*. Then, in step S8, the sheet feeding motor 106 is operated in the forward direction by a predetermined number of steps, to rotate the registering rollers 22*a*, 22*b* for feeding the cut sheet P to a predetermined recording-start position at which a recording operation of the recording head 4 on the cut sheet P is initiated.

Step S8 is followed by step S9 in which the recording operation of the recording head 4 is performed to eject ink droplets from its nozzles to form an image on the cut sheet P while the carriage is reciprocated in the main scanning direction (Y-axis direction) and while the cut sheet P is intermittently advanced in the X-axis direction. After the recording operation, the sheet feeding motor 106 is continuously operated in the forward direction, in step S10, to eject the cut sheet P into the recorded-sheet receiver 10. Where the recording operation is performed on a plurality of cut sheets P fed from the first sheet supply cassette 3A, steps S7-S10 are repeatedly implemented.

When the second sheet supply cassette 3B is selected by a command received from the external computer, a negative decision (no) is obtained in step S6, and the control flow goes to step S11 to move the carriage 5 rightwards toward the maintenance unit 101, to the position of meshing engagement of the shift gear 109 with the second input spur gear 113 shown in FIG. 14C. During this movement of the carriage 5, an inching operation of the sheet feeding motor 106 is performed in step S12, in the same manner as described above with respect to the step S5, to assure smooth sliding movement of the shift gear 109 into meshing engagement with the second spur gear 113. When the shift gear 109 is in meshing engagement with the second spur gear 113, the reverse operation of the sheet ceding motor 106 permits the sheet supply roller 65*b* to be rotated in the forward direction through the second power transmitting portion 103 to feed the uppermost cut sheet P from the stack accommodated in the second sheet supply cassette 3B in the sheet feeding direction A.

Then, in step S13, the sheet feeding motor 106 is operated in the reverse direction until the leading edge of the cut sheet P fed from the second sheet supply cassette 3B reaches the pressure nip of the registering rollers 22*a*, 22*b*. That is, the reverse operation of the motor 106 is continued by a predetermined number of steps after the leading edge of the cut sheet P is detected by the sheet-edge sensor 131. Step S13 is followed by step S14 in which the motor 106 is operated in the forward direction by a predetermined number of steps to rotate the registering rollers 22*a*, 22*b* for feeding the cut sheet P to the predetermined recording-start position. Step S15 is then implemented to move the carriage 5 into the recording area L, for meshing engagement of the shift gear 109 with the first input spur gear 110. For smooth sliding movement of the shift gear 109 into meshing engagement with the first input spur gear 110, an inching operation of the sheet feeding motor 106 is performed in step S16, in the same manner as described above with respect to steps S5 and S12. Then, steps S17 and S18 similar to the above-described steps S9 and S10 are implemented.

As described above, the shift gear 109 is shifted from its position of meshing engagement with the third input spur gear 116 to its position of meshing engagement with the first input spur gear 110 via its position of meshing engagement with the second input spur gear 113, in steps S3 before the recording operation is initiated. Further, the shift gear 109 is shifted from its position of meshing engagement with the first input spur gear 110 to its position of meshing engagement with the second input spur gear 113 in step S12 before the cut sheet P is fed to the predetermined recording-start position from the second sheet supply cassette 3B. Thus, the power-transmission switching device 105 including the shift gear 109 facilitate the selective power transmission from the sheet feeding motor 106 (from the drive-force output device including the drive gear 108) to the first sheet feeding device 6 or the second sheet feeding device 65.

As described above, the three input spur gears 110, 113, 116 are arranged in this order of description in their axial direction (main scanning direction or Y-axis direction such that the first input spur gear 110 is nearest to the side plate 16*a*, and the third input spur gear 116 is nearest to the maintenance unit 101 while the second input spur gear 113 is located between the first and third input spur gears 110, 116. This order of arrangement of the three input spur gears 110, 113, 116, together with the arrangement that the shift gear 109 is normally held in meshing engagement with the first input spur gear 110 is advantageous in that the first sheet supply cassette 3A which is usually set in the first lower casing 20 can be set ready for use in a relatively short time after reception of a printing start command.

The arrangement of the three input spur gears 110, 113 and 116 has a further advantage that the first, second and third power transmitting devices 102, 103, 104 including the respective input spur gears 110, 113, 116 can be operatively connected to the respective driven gears 112, 115, 118 for the first and second sheet feeding devices 6, 65 and maintenance unit 101, with shortest power transmission paths, so that not only the power transmission efficiency is improved for each of those feeding devices 6, 65 and maintenance unit 101, but also the image-recording apparatus 1 can be made small sized in the main scanning direction.

Further, the purging operation of the recording head 4 by the maintenance unit 101 can be performed, upon replacement of the ink cartridges, for example, by moving the carriage 5 to the standby position at the right end of the main frame 16, which is on the right side of the recording area L (shown in FIG. 3).

Where only the first sheet supply cassette 3A is provided, the second input spur gear 113 may remain between the first and third input spur gears 110, 116, since the intermediate gears 114*a*-114*d*, etc. are not provided downstream of the second input spur gear 113. In this case, the second input spur gear 113 may be replaced by a cylindrical member which does not engage the shift gear 109.

Referring further to FIGS. 18-21, there will be described the biasing device for biasing the roller support arm 65*a* of the second sheet feeding device 65 for the second sheet supply cassette 3B. As described above by reference to FIGS. 10-12, the drive shaft 66 of the second sheet feeding device 65 is rotatably supported by the shaft support plates 67*a*, 67*b*, 67*c* of the support frame 67, such that the end portion of the drive shaft 66 which is remote from the driven gear 115 extends through the proximal end portion of the roller support arm 65*a* and the shaft holes 142 of the shaft support plates 67*a*, 67*b*, as shown in FIGS. 18-21.

Figure 21:
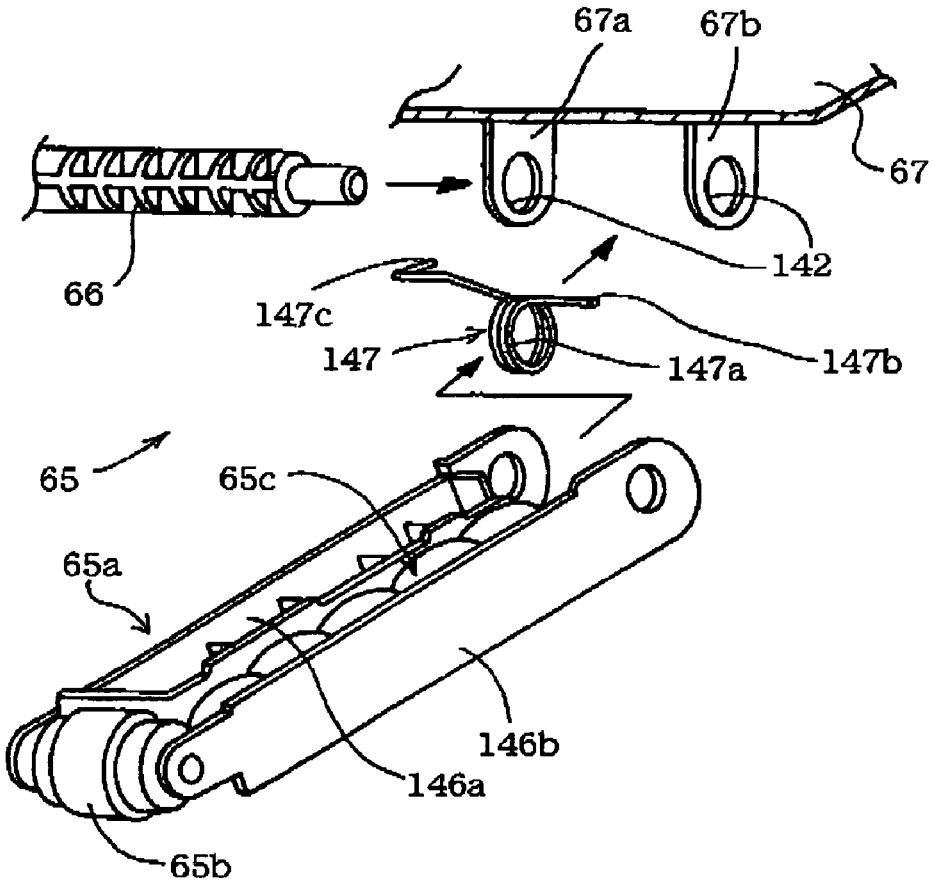
FIG. 21 is a perspective view of the second sheet feeding device.

As most clearly shown in FIG. 21, the roller support arm 65*a* has a pair of parallel elongate side plates 146*a*, 146*b* which extend in the radial direction of the drive shaft 66 and which support the sheet supply roller 65*b* at their free ends. The proximal end portions of the side plates 146*a*, 146*b* are positioned between the shaft support plates 67*a*, 67*b* that are opposed to each other in the axial direction of the drive shaft 66. The side plates 146*a*, 146*b* support five gears of the gear transmission mechanism 65*c* such that a train of the five gears is disposed between the two side plates 146*a*, 146*b* and located nearer to the side plate 146*b* than to the side plate 146*a*. The roller support arm 65*a* is biased by a biasing device in the form of a torsion spring 147 such that the roller support arm 65*a* is biased pivotally about the drive shaft 66 in a direction for moving the free end portion of the roller support arm 65*a* toward the stack of cut sheets P accommodated in the second sheet supply cassette 3B, while at the same time the roller support arm 65*a* is biased against the shaft support plate 67*a* in the axial direction of the drive shaft 66, that is, in the direction perpendicular to the longitudinal direction of the elongate side plates 146*a*, 146*b*.

Figure 19:
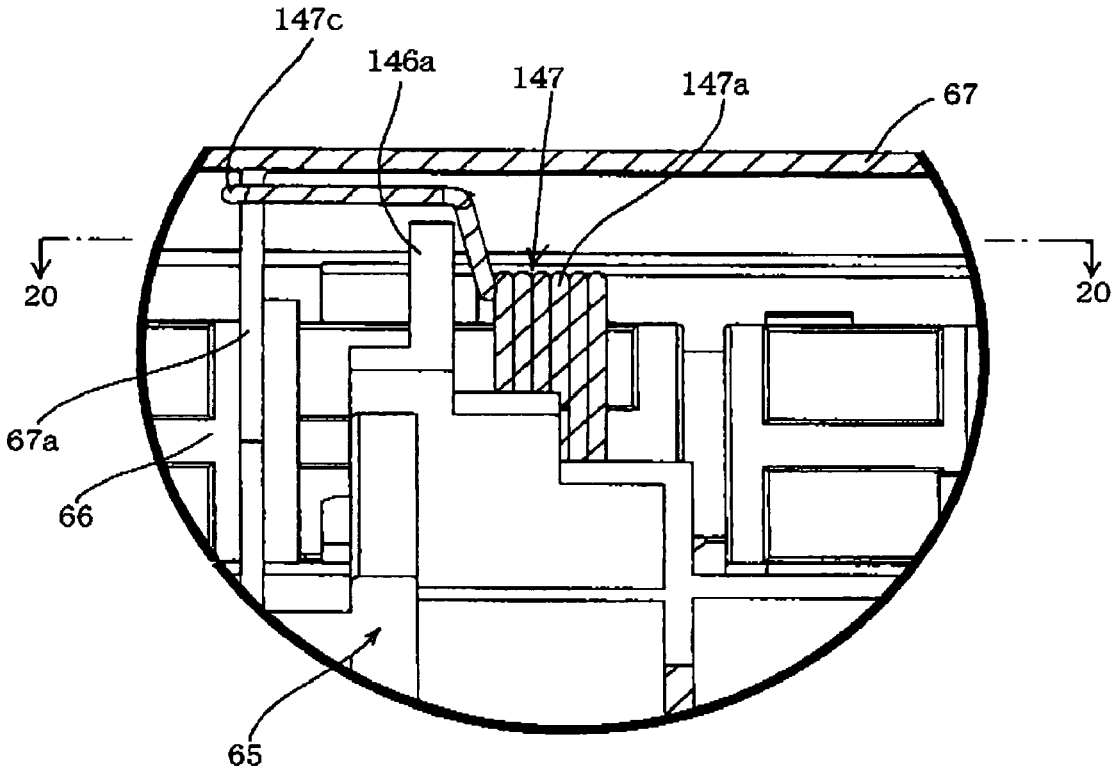
FIG. 19 is a view showing in enlargement an encircled portion of FIG. 18B.
Figure 20:
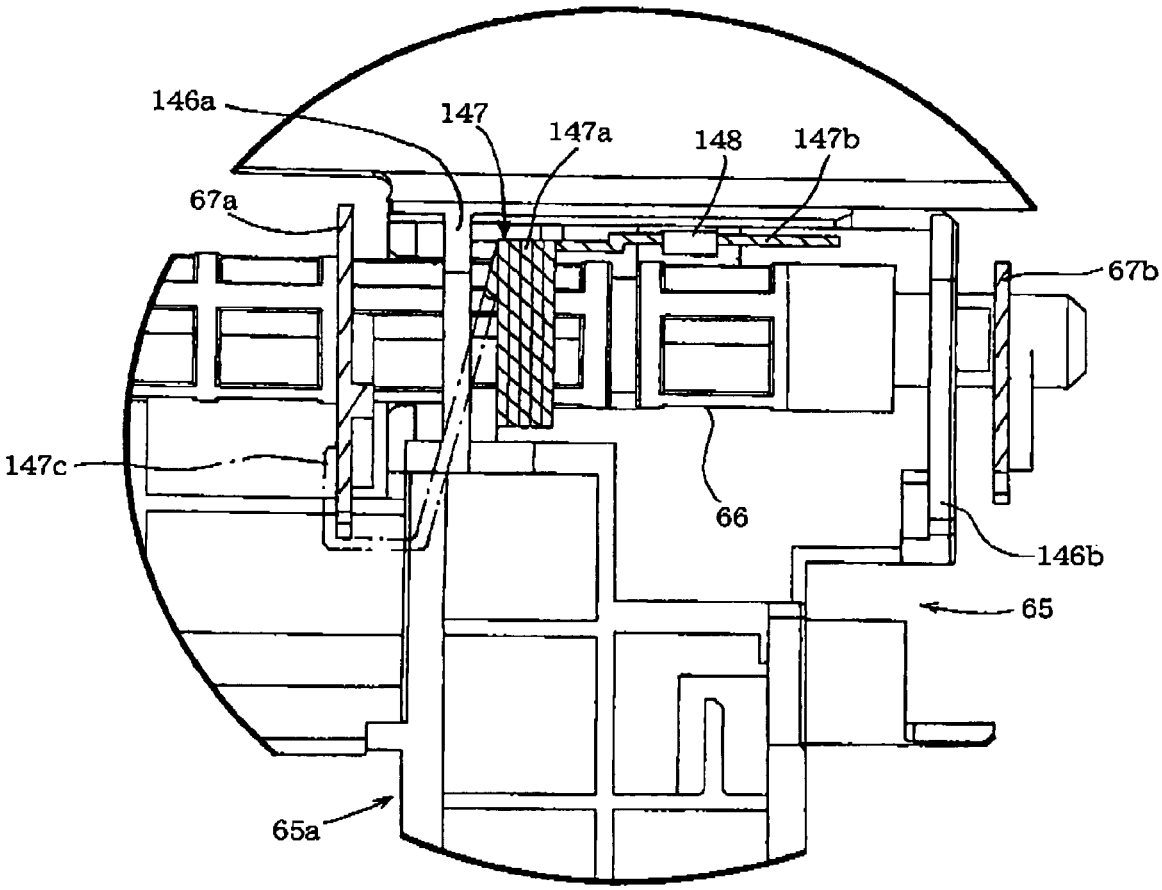
FIG. 20 is an elevational view taken along line 20-20 of FIG. 19.

Described in greater detail, the torsion spring 147 includes an intermediate coil portion 147*a* and two end portions 147*a* and 147*b* extending from the respective opposite ends of the coil portion 147*a*, as shown in FIGS. 20 and 21. As shown in FIG. 20, the torsion spring 147 is fixed to the proximal end portion of the roller support arm 65*a* on the side of the shaft support plates 67*a*, 67*b* of the support frame 67, such that the coil portion 147*a* is fitted on a portion of the drive shaft 66 between the two elongate side plates 146*a*, 146*b* and is located adjacent to the side plate 146*a*. The first end portion 147*b* extends from the coil portion 147*a* in one axial direction of the drive shaft 66 toward the side plate 146*b* (on the side of the shaft support plate 67*b*) and is fixed to a retainer portion 148 formed integrally with the roller support arm 65*a*. The other or second end portion 147*c* generally extends from the coil portion 147*a* in the other axial direction of the drive shaft 66 toward the shaft support plate 67*a*, and has a bent distal end portion which is generally U-shaped as seen in FIG. 20 and held at its extreme end part in pressing contact with the outer surface of the shaft support plate 67*a*, as also shown in FIG. 19, so that the roller support arm 65*a* is biased against the shaft support plate 67*a*.

Thus, the torsion spring 147 biases the roller support arm 65*a* at its proximal end, not only pivotally about the drive shaft 66 for normally holding the sheet supply roller 65*b* in pressing contact with the top surface of the stack of cut sheets P in the second sheet supply cassette 3B, but also axially of the drive shaft 66 toward the shaft support plate 67*a* of the support frame 67. Accordingly, the torsion spring 147 prevents a rattling movement of the roller support arm 65*a* at its proximal end portion in the direction perpendicular to its longitudinal direction, that is, in the axial direction of the drive shaft 66, and therefore prevents a rattling movement of the roller support arm 65*a* at its distal end portion in the axial direction of the drive shaft 66. Therefore, the torsion spring 147 permits the roller support arm 65*a* to extend exactly in the radial direction of the drive shaft 66 such that the longitudinal direction of the roller support arm 65*a* is exactly perpendicular to the axial direction of the drive shaft 66, so that the axis of rotation of the sheet supply roller 65*b* at the distal end of the roller support arm 65*a* is exactly parallel to the axis of rotation of the drive shaft 66, permitting the cut sheets P to be fed exactly in the predetermined feeding direction A (in the X-axis direction). In other words, the torsion spring 147 prevents the conventionally experienced inclination of the axis of rotation of the sheet supply roller 65*b* with respect to the direction perpendicular to the sheet feeding direction A, so that the sheet supply roller 65*b* can feed each cut sheet P exactingly in the predetermined feeding direction A, without a risk of jamming of the cut sheet P.

It is noted that the second sheet supply cassette 3B has a larger height dimension than the first second sheet supply cassette 3A, so that the maximum height of the stack that can be accommodated in this second sheet supply cassette 3B is larger than that of the first sheet supply cassette 3A. Accordingly, the roller support arm 65*a* has a considerably larger length than the roller support arm 6*a*, as shown in FIG. 2. In this respect, the provision of the torsion spring 147 is effective to prevent the above-described rattling movement of the roller support arm 65*a* and inclination of the axis of rotation of the sheet supply roller 65*b* with respect to the axial direction of the drive shaft 66.

Further, the torsion spring 147 biasing the roller support arm 65*a* for holding the sheet supply roller 65*b* in pressing contact with the sheet stack while preventing the rattling movement of the roller support arm 65*a* at its proximal end portion is simple in construction and available at a relatively low cost.

The positioning of the torsion spring 147 such that the coil portion 147*a* is located near to the side plate 146*a* than to the side plate 146*b* (nearer to the shaft support plate 67*a* than to the shaft support plate 67*b*) is significant to assure even or uniform pressing contact of the sheet supply roller 65*b* with the sheet stack in the axial direction of the roller 65*b*. That is, the five gears of the gear transmission mechanism 65*c* is located nearer to the side plate 146*b* on the side of the shaft support plate 67*b*, so that the weight of the mechanism 65*c* causes application of a larger force to the sheet supply roller 65*b* at its axial end on the side of the side plate 146*b*, that at its axial end on the side of the side plate 146*a*. To assure even application of force to the roller 65*b* in its axial direction, therefore, the biasing force of the torsion spring 147 acting on the roller support arm 65*a* is preferably made larger on the side of the side plate 146*a* (shaft support plate 67*a*) than on the side of the side plate 146*b* (shaft support plate 67*b*). In this respect, the positioning of the torsion spring 147 relative to the roller support arm 65*a* in the present embodiment is desirable to assure even pressure of pressing contact of the sheet supply roller 65*b* with the sheet stack over the entire axial length of the roller 65*b*.

As described above, the roller support arm 6*a* of the first sheet feeding device 6 for the first sheet supply cassette 3A is biased by a suitable biasing device for normally holding the sheet supply roller 6*b* at the distal end of the roller support arm 6*a* in pressing contact with the sheet stack in the first sheet supply cassette 3A. This biasing device is preferably a torsion spring similar to the torsion spring 147, which is fixed to the proximal end portion of the roller support arm 6*a* and one of the two shaft support plates 63 of the main frame 16, so that the roller support arm 6*a* is biased in the axial direction of the drive shaft 74, as well as in the direction of pivoting of the arm 6*a* about the axis of rotation of the drive shaft 74, to prevent inclination of the axis of rotation of the roller 6*b* with respect to the axis of rotation of the drive shaft 74.

While the second sheet supply cassette 3B is arranged to accommodate the sheet stacks such that the top surface of the sheet stack is parallel to the horizontal plane, the cassette 3B may be arranged to accommodate the sheet stack such that the top surface of the sheet stack is inclined with respect to the horizontal plane, similarly ot the first sheet supply cassette 3A, as seen in FIG. 2.

Figure 22:
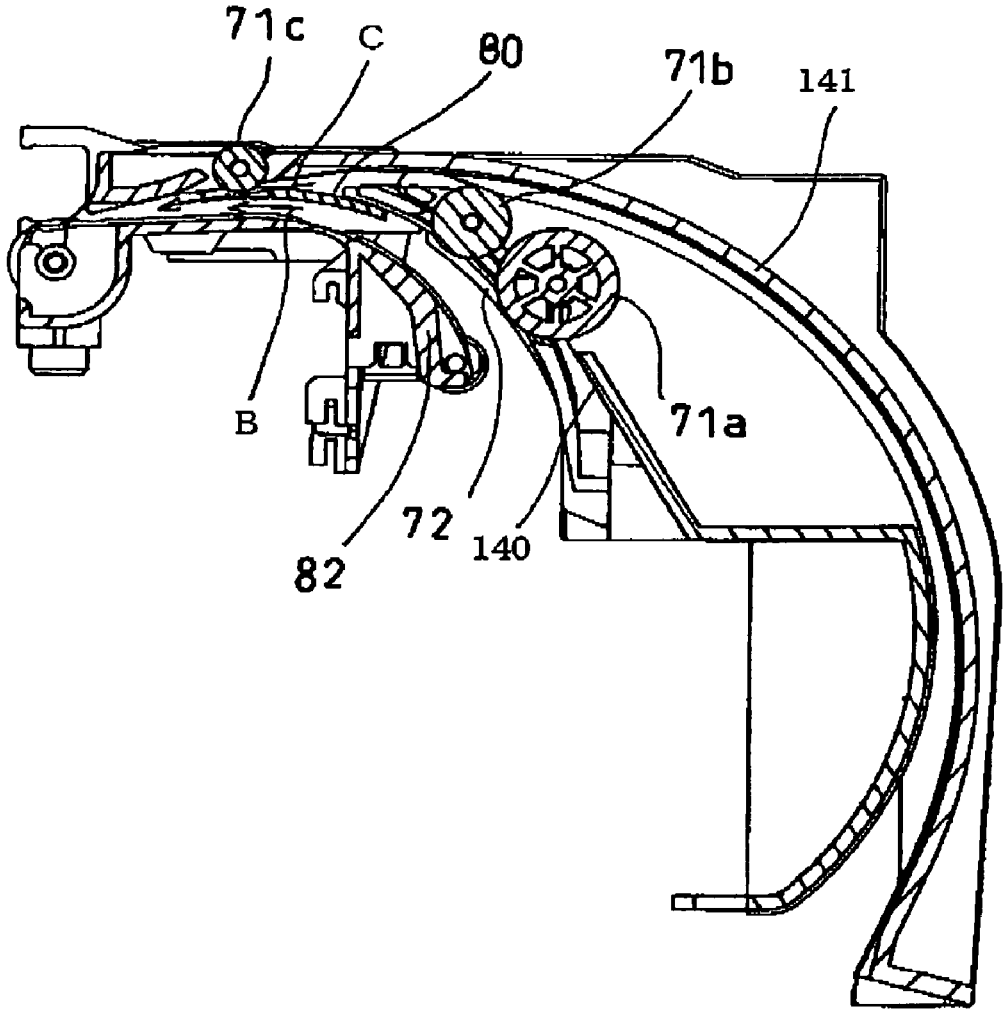
FIG. 22 is a side elevational view showing first-path and second-path members defining first and second U-turn paths along which cut sheets are fed by the first and second sheet feeding devices, in another embodiment of this invention.
Figure 23:
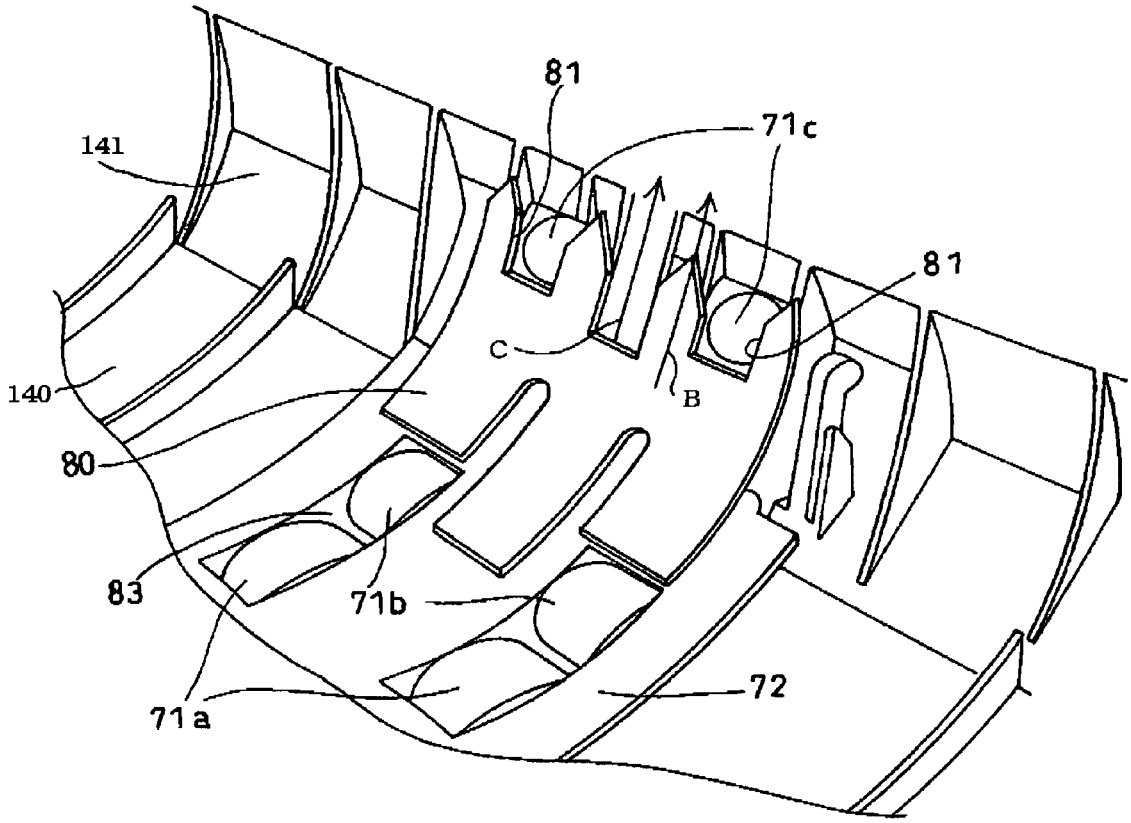
FIG. 23 is a fragmentary perspective view showing a portion of a sheet feeding path at which the first and second U-turn paths merge with each other in the embodiment of FIG. 22.

Referring further to FIGS. 22 and 23, there will be described an arrangement in another embodiment of this invention to prevent jamming of the cut sheet P at the point of merging of the U-turn paths which are defined by a first-path member 140 and a second-path member 141 and which extend from the first and second sheet supply cassettes 3A, 3B, to feed the cut sheets P to the image-recording portion 7 disposed above the first sheet supply cassette 3A, as shown in FIG. 2.

As shown in enlargement in FIG. 22, the U-turn path defined by the second-path member 141 has a larger radius of curvature than the U-turn path defined by the first-path member 140, and is formed rearwardly of the U-turn path defined by the first-path member 140. The first-path member 140 and the second-path member 141 are assembled together such that the downstream end of the first-path member 140 as viewed in the sheet feeding direction A is located below and adjacent to a downstream portion of the second-path member 141, so that the U-turn path defined by the first-path member 140 merges with the U-turn path defined by the second-path member 141, at the position of the above-indicated downstream portion of the second-path member 134, from which the cut sheet P is further fed toward the image-recording portion 7. On the front side and inwardly of the first-path member 140, there is disposed a third-path member 82 which cooperates with the first-path member 140 to facilitate a movement of the cut sheet P in the reverse direction opposite to the sheet feeding direction A.

The first-path member 140 is provided with two pairs of idler rollers 71*a*, 71*b* (fist and second pairs), while the second-path member 141 is provided with a pair of idler rollers 71*c* (third pair), as shown in FIGS. 22 and 23. These three pairs of idler rollers 71*a*, 71*b*, 71*c*, which are provided to facilitate the feeding of the cut sheet P, are located near the point of merging of the U-turn paths defined by the first-path and second-path members 140, 141, and in an almost middle portion of the U-turn paths as seen in the width direction of the cut sheet P, such that the two idler rollers 71 of each pair are spaced apart from each other in the width direction of the cut sheet P, and such that the first, second and third pairs 71*a*, 71*b*, 71*c* are spaced apart from each other and arranged in the order of description in the sheet in the sheet feeding direction A. However, the first-path and second-path members 140, 141 may be provided with a suitable number of pairs of idler rollers 71 other than two.

As shown in FIG. 23, the first-path member 140 has two recesses 83 which are open in the inner surface defining the U-turn path and through which the first and second pairs of idler rollers 71*a*, 71*b* are exposed. The above-indicated inner surface of the first-path member 140 is covered by a covering member 72 which is formed of a synthetic resin and which is removably attached to the first-path member 140. The covering member 72 has two apertures which permit partial exposure of the idler rollers 71*a*, 71*b* but inhibit exposure of the support shafts of the idler rollers 71*a*, 71*b*.

As also shown in FIG. 23, a guide member 80 formed from a flexible sheet is fixed to the covering member 72 such that the guide member 80 extends in the sheet feeding direction A. Described more specifically, the guide member 80 is bonded at its upstream end portion to the downstream end portion of the covering member 72 which is downstream of the second pair of idler rollers 71*b*. The downstream or free end portion of the guide member 80 has its extreme downstream end located downstream of the third pair of idler rollers 71*c*, but has cutouts 81 that permit partial exposure of the third pair of idler rollers 71*c*

The downstream end portion of the guide member 80 which has the cutouts 81 are saw-toothed so that rows of burrs formed by forming the cutouts 81 with the saw-toothed downstream end portion are inclined with respect to the sheet feeding direction A. Namely, the direction of extension of the rows of burrs that would be formed if the cutouts 81 were formed without the saw-toothed downstream end portion is perpendicular to the sheet feeding direction A, and the burrs would prevent smooth feeding of the cut sheet P.

In the present embodiment of FIGS. 22 and 23 described above, the cut sheet P fed from the lower second sheet supply cassette 3B along the U-turn path defined by the second-path member 141 is passed between the first-path and second-path members 140, 141, and then passed between the outer surface of the guide member 80 and the third pair of idler rollers 71*c*, as indicated by arrow-headed line C in FIGS. 22 and 23. On the other hand, the cut sheet P fed from the upper first sheet supply cassette 3A along the U-turn path defined by the first-path member 140 is advanced in sliding contact with the first and second pairs of idler rollers 71*a*, 71*b*, the inner surface of the guide member 80, and the third pair of idler rollers 71*c*, as indicated by arrow-headed line B. Since the radius of curvature of the U-turn path defined by the first-path member 140 is smaller than that of the U-turn path defined by the second-path member 141, the leading edge of the cut sheet P sliding on the inner surface of the first-path member 140 tends to spring back onto the inner surface of the second-path member 141, due to a resilient force generated by the leading end portion of the cut sheet P upon movement of the leading edge past the downstream end of the first-path member 140. In the absence of the guide member 80, therefore, the leading edge of the cut sheet P would tend to abut on the outer circumferential surfaces of the third pair of idler rollers 71*c* in the direction normal to the circumferential surfaces, giving rise to a risk of feeding failure and jamming of the cut sheet P at the idler rollers 71*c*. However, the provision of the guide member 80 permits the cut sheet P to be fed in the tangential direction of the idler rollers 71*c*, while being guided by the idler rollers 71*c*.

Thus, the three pairs of idler rollers 71*a*, 71*b*, 71*c* and the guide member 80 assure smooth feeding movements of the cut sheets P toward the image-recording head 7, along the U-turn paths defined by the first-path and second-path members 140, 141, as indicated by the arrow-headed lines B and C in FIGS. 22 and 23, without a risk of jamming of the cut sheets P at the point of merging of the two U-turn paths extending from the first and second sheet supply cassettes 3A and 3B.

Figure 17:
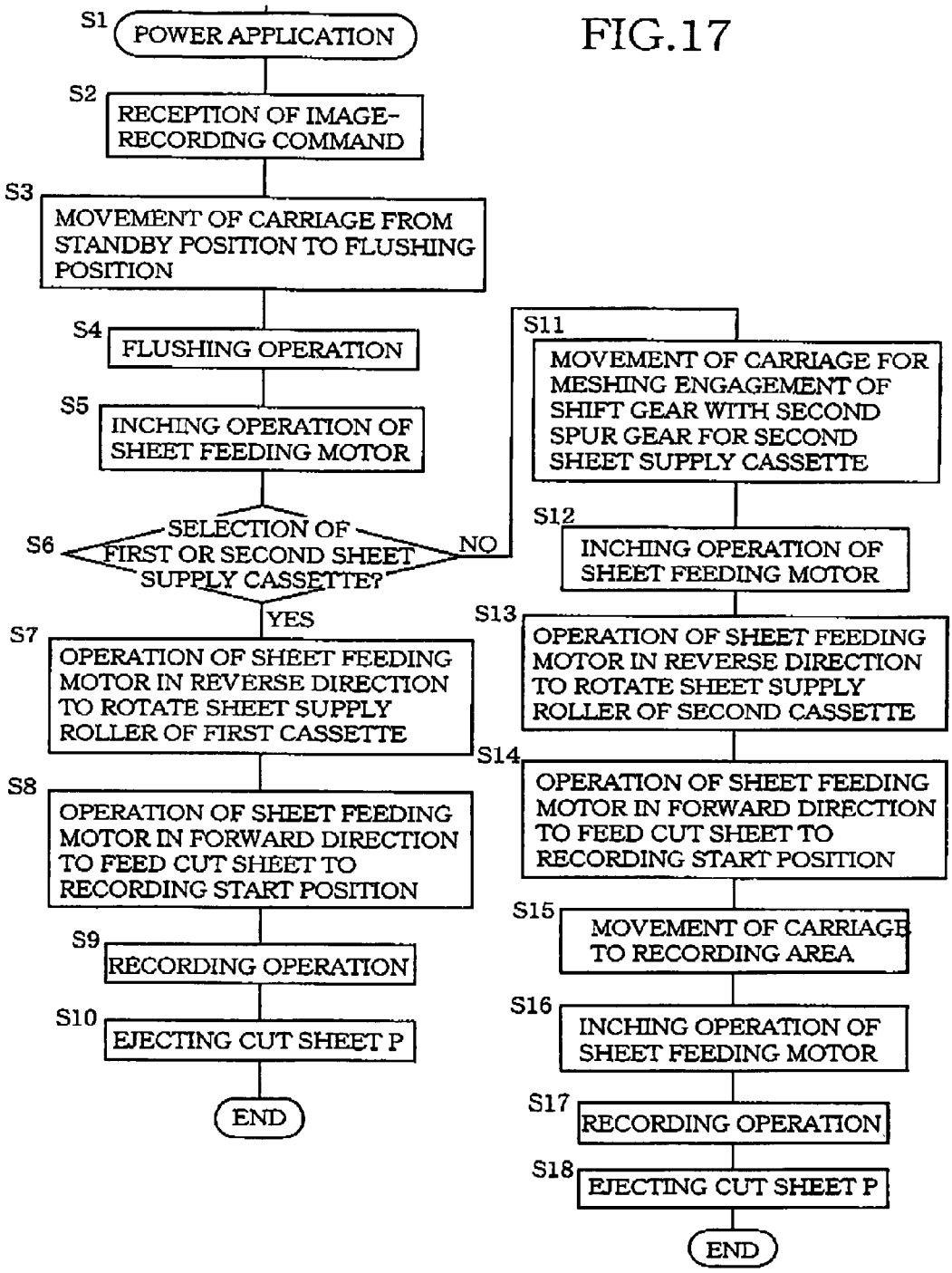
FIG. 17 is a flow chart illustrating a control routine for controlling the power transmission switching device.
Figure 18A:
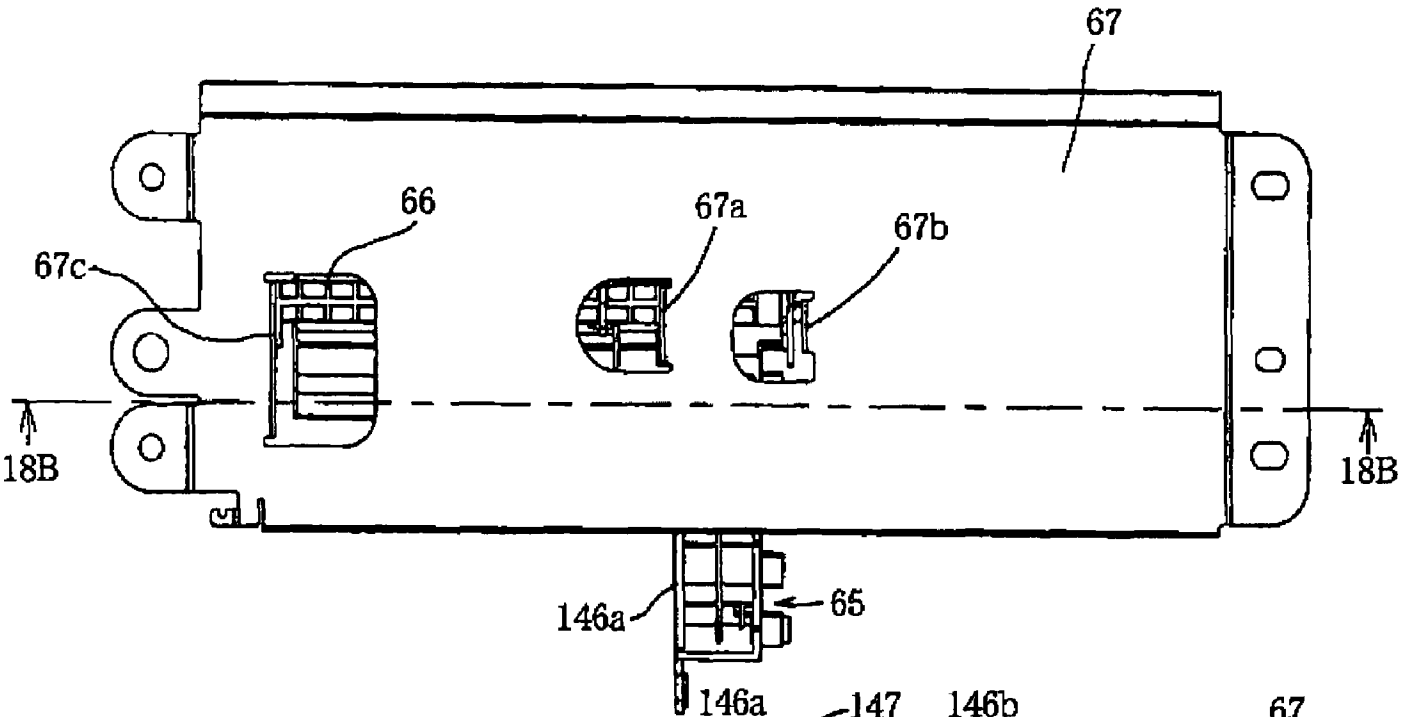
FIG. 18A is a plan view of a support frame supporting the second sheet feeding device.
Figure 18B:
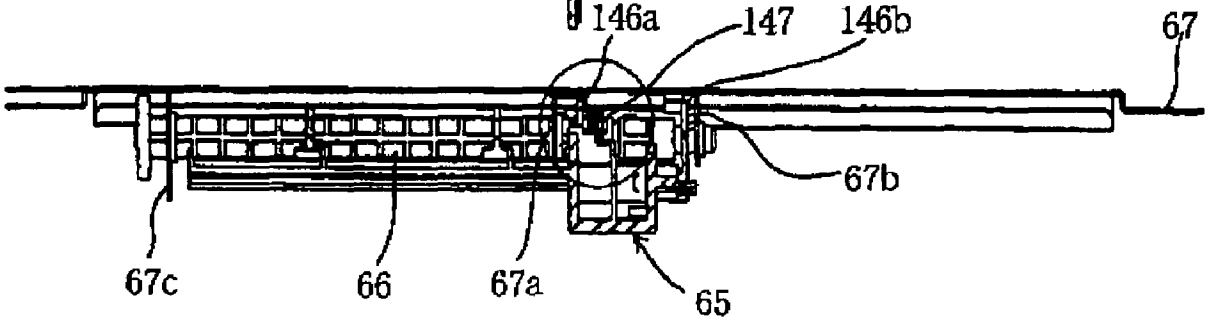
FIG. 18B is a cross sectional view taken along line 18B-18B of FIG. 18A.

While the preferred embodiments of this invention have been described in detail by reference to the accompanying drawings, for illustrative purpose only, it is to be understood that the present invention is not limited to the details of the illustrated embodiments, but may be embodied with various changes and modifications. For example, the principle of the present invention is applicable to an image-recording apparatus having three or more sheet supply cassettes. Where the apparatus is provided with three sheet supply cassettes are provided, the shift gear 109 of the power-transmission switching device 105 is arranged to be shifted for selective engagement with a first spur gear for the uppermost sheet supply cassette, a second spur gear for the intermediate sheet supply cassette, a third spur gear or the lowermost sheet supply cassette, and a fourth spur gear for the maintenance unit 101. The first, second, third and fourth spur gears are arranged in the right direction in the order of description, such that the first spur gear is nearest to the recording area L while the fourth spur gear is furthest from the recording area L. In this case, too, the inching operation of the sheet feeding motor 106 as described above with respect to the apparatus 1 provided with the two sheet supply cassettes 3A, 3B is performed to assure a smooth movement of the shift gear from its position of meshing engagement with the fourth spur gear to its position of meshing engagement with the first spur gear. The operations of the apparatus provided with the three sheet supply cassettes, which includes the inching operation, are controlled in substantially the same manner as described above by reference to the flow chart of FIG. 17.

What is claimed is:

1. An image-recording apparatus comprising (a) a recording head operable to record an image on a recording medium, (b) a carriage carrying said recording head and reciprocable in a main scanning direction, (c) a guide device guiding said carriage in said main scanning direction, and (d) a maintenance device disposed at a predetermined standby position located outside a predetermined recording area of said recording head in said main scanning direction and operable to perform a maintenance operation of said recording head when said carriage is located at said standby position, the image-recording apparatus further comprising:

a plurality of medium supply cassettes which are superposed on each other and each of which is open upwards and accommodates a stack of recording media;

a plurality of medium feeding devices which are operable to feed said recording media from the respective stacks accommodated in said plurality of medium supply cassettes, one after another along a feeding path;

a plurality of power transmitting devices disposed on one of opposite sides of said predetermined recording area which corresponds to said standby position, said plurality of power transmitting devices respectively corresponding to said maintenance device and said plurality of medium feeding devices and including respective power transmitting members, the power transmitting member corresponding to said maintenance device being located furthest from said recording area in said main scanning direction, while the power transmitting member corresponding to an uppermost one of said plurality of medium feeding devices being located nearest to said recording area in said main scanning direction;

a drive-force output device operable to produce a drive force; and a power-transmission switching device operable to transmit said drive force selectively to one of said power transmitting members, according to a distance of movement of said carriage in said main scanning direction from one of opposite ends of said recording area which corresponds to said one of the opposite sides;

wherein said plurality of power transmitting devices include respective at least three gears which are disposed coaxially and in series with each other, and said power-transmission switching device includes a shift gear which receives said drive force produced by said drive-force output device and which is movable in an axial direction of said at least three gears of said power transmitting devices parallel to said main scanning direction for selective meshing engagement with one of said at least three gears, said power-transmission switching device further including an engaging portion engageable with said carriage to move said shift gear in said axial direction.

2. An image-recording apparatus comprising (a) a recording head operable to record an image on a recording medium, (b) a carriage carrying said recording head and reciprocable in a main scanning direction, (c) a guide device guiding said carriage in said main scanning direction, and (d) a maintenance device disposed at a predetermined standby position located outside a predetermined recording area of said recording head in said main scanning direction and operable to perform a maintenance operation of said recording head when said carriage is located at said standby position, the image-recording apparatus further comprising:

a plurality of medium supply cassettes which are superposed on each other and each of which is open upwards and accommodates a stack of recording media;

a plurality of medium feeding devices which are operable to feed said recording media from the respective stacks accommodated in said plurality of medium supply cassettes, one after another along a feeding path;

a plurality of power transmitting devices disposed on one of opposite sides of said predetermined recording area which corresponds to said standby position, said plurality of power transmitting devices respectively corresponding to said maintenance device and said plurality of medium feeding devices and including respective power transmitting members, the power transmitting member corresponding to said maintenance device being located furthest from said recording area in said main scanning direction, while the power transmitting member corresponding to an uppermost one of said plurality of medium feeding devices being located nearest to said recording area in said main scanning direction;

a drive-force output device operable to produce a drive force; and a power-transmission switching device operable to transmit said drive force selectively to one of said power transmitting members, according to a distance of movement of said carriage in said main scanning direction from one of opposite ends of said recording area which corresponds to said one of the opposite sides, wherein said plurality of medium supply cassettes include a first medium supply cassette and a second medium supply cassette on which said first medium supply cassette is superposed, and said plurality of medium feeding devices include a first sheet feeding device and a second sheet feeding device respectively corresponding to said first and second medium supply cassettes, each of said first and second medium feeding devices including a medium supply roller operable to feed the recording medium from the stack in the corresponding one of said first and second medium supply cassettes in a secondary scanning direction perpendicular to said main scanning direction, a transmission mechanism operatively connected to said medium supply roller, and a roller support arm supporting said medium supply roller and said transmission mechanism, said plurality of power transmitting devices including a first power transmitting device, a second power transmitting device and a third power transmitting device which respectively correspond to said first and second medium feeding devices and said maintenance device and which are disposed between said one of the opposite ends of said recording area and said maintenance device and arranged in the order of description in said main scanning direction from said one of the opposite ends toward said maintenance device.

3. The image-recording apparatus according to claim 2, wherein said first, second and third power transmitting devices respectively include, as said power transmitting members, first, second and third input gears which are disposed coaxially and in series with each other, and said drive-force output device includes an output gear rotatable about an axis parallel to an axis of rotation of said input gears, said power-transmission switching device including an intermediate gear held in meshing engagement with said output gear and axially movable in said main scanning direction for selective meshing engagement with one of said first, second and third input gears, and an engaging portion engageable with said carriage to move said intermediate gear in said main scanning direction.

4. The image-recording apparatus according to claim 3, wherein said first, second and third input gears, said output gear and said intermediate gear are all spur gears which have the same pitch and tooth profile.

5. The image-recording apparatus according to claim 3, wherein said drive-force output device includes a common bidirectionally operable drive motor, a feed roller which is rotated by said drive motor and which partially defines said feeding path, and a drive shaft of said feed roller, said output gear being rotated by said drive shaft.

6. The image-recording apparatus according to claim 3, wherein said engaging portion of said power-transmission switching device is a first engaging portion, and said carriage has a second engaging portion engageable with said first engaging portion to move said intermediate gear.

7. The image-recording apparatus according to claim 3, wherein said engaging portion of said power-transmission switching device has a first position, a second position and a third position for meshing engagement of said intermediate gear with said first, second and third input gears, respectively, said first, second and third positions being spaced apart from each other in said main scanning direction;

said engaging portion being held in said third position when said carriage is located at said predetermined standby position, and moved from said third position to said first position via said second position when said carriage is moved from said standby position into said predetermined recording area in said main scanning direction while said engaging portion is held in engagement with the carriage.

8. The image-recording apparatus according to claim 7, wherein said power-transmission switching device further includes a movable block which is movable relative to said intermediate gear in an axial direction of said intermediate gear and which has an abutting portion as said engaging portion, and said carriage has a protrusion which comes into abutting contact with said abutting portion when said carriage is moved in said main scanning direction away from said predetermined recording area.

9. The image-recording apparatus according to claim 8, wherein said power-transmission switching device further includes a first biasing member biasing said movable block in a first direction to hold said engaging portion in said first position for meshing engagement of said intermediate gear with said first input gear, and a second biasing member biasing said intermediate gear in a second direction opposite to said first direction to move said intermediate gear for meshing engagement of the intermediate gear with said second and third input gears when said movable block is moved in said second direction by said carriage against a biasing force of said first biasing member.

10. The image-recording apparatus according to claim 9, wherein said movable block and said intermediate gear are disposed between said first and second biasing members, and said second biasing member has a biasing force smaller than the biasing force of said first biasing member.

11. The image-recording apparatus according to claim 9, wherein said drive-force output device includes a common bidirectionally operable drive motor operatively connected to said output gear, said apparatus further comprising a carriage drive motor operable to move said carriage in said main scanning direction, and a controller which controls said carriage drive motor and said common bidirectionally operable drive motor, and wherein said controller is operable to control said common bidirectionally operable drive motor to perform an inching operation for a smooth movement of said intermediate gear in sliding contact with said output gear and said first, second and third input gears, when said carriage drive motor is operated to move said carriage in said main scanning direction to move said abutting portion from one of said first, second and third positions to another, said inching operation of said common bidirectionally operable drive motor including a stepping operation in a forward direction by a predetermined angel small than an angle corresponding to a tooth pitch of said output gear, said intermediate gear and said first, second and third input gears, and a stepping operation in a reverse direction by said predetermined angle.

12. An image-recording apparatus comprising (a) a recording head operable to record an image on a recording medium, (b) a carriage carrying said recording head and reciprocable in a main scanning direction, (c) a guide device guiding said carriage in said main scanning direction, and (d) a maintenance device disposed at a predetermined standby position located outside a predetermined recording area of said recording head in said main scanning direction and operable to perform a maintenance operation of said recording head when said carriage is located at said standby position, the image-recording apparatus further comprising:

a plurality of medium supply cassettes which are superposed on each other and each of which is open upwards and accommodates a stack of recording media;

a plurality of medium feeding devices which are operable to feed said recording media from the respective stacks accommodated in said plurality of medium supply cassettes, one after another along a feeding path;

a plurality of power transmitting devices disposed on one of opposite sides of said predetermined recording area which corresponds to said standby position, said plurality of power transmitting devices respectively corresponding to said maintenance device and said plurality of medium feeding devices and including respective power transmitting members, the power transmitting member corresponding to said maintenance device being located furthest from said recording area in said main scanning direction, while the power transmitting member corresponding to an uppermost one of said plurality of medium feeding devices being located nearest to said recording area in said main scanning direction;

a drive-force output device operable to produce a drive force; and a power-transmission switching device operable to transmit said drive force selectively to one of said power transmitting members, according to a distance of movement of said carriage in said main scanning direction from one of opposite ends of said recording area which corresponds to said one of the opposite sides, wherein said plurality medium supply cassettes and said plurality of power transmitting devices are disposed below said guide device, and said power-transmission switching device is supported by said guide device.

13. The image-recording apparatus according to claim 12, wherein said power transmitting members of said power transmitting devices are input gears disposed coaxially with each other, and said drive-force output device includes an output gear rotatable about an axis parallel to an axis of rotation of said input gears, said power-transmission switching device including an intermediate gear held in meshing engagement with said output gear and axially movable in said main scanning direction for selective meshing engagement with one of said input gears, and a movable block which carries an abutting portion and which is movable relative to said intermediate gear in an axial direction of said intermediate gear, said abutting portion extending upwards from said movable block through said guide device and abuttable on said carriage, to move said movable block and said intermediate gear in said main scanning direction.

14. The image-recording apparatus according to claim 1, wherein each of said plurality of medium feeding devices includes a drive shaft connected to said drive-force output device and rotatably supported by a support frame, a support arm having a free end portion and a proximal end portion through which said drive shaft extends rotatably, and a rotary medium-supply member rotatably supported by said free end portion of said support arm and rotated by said drive shaft, and wherein at least one of said plurality of medium feeding devices further includes a biasing device which biases said support arm pivotally about an axis of rotation of said drive shaft in a direction for moving said free end portion toward said stack of recording media, while at the same time biases said support arm in an axial direction of the drive shaft against said support frame.

15. The image-recording apparatus according to claim 14, wherein said support frame has an abutting surface, and said biasing device biases said support arm for pressing contact with said abutting surface in the axial direction of said drive shaft.

16. The image-recording apparatus according to claim 14, wherein said biasing device includes a torsion spring disposed in engagement with said support frame and said proximal end portion of said support arm, and said torsion spring has opposite end portions one of which engages said support arm and the other of which engages said support frame such that said support arm is biased by said torsion spring against said support frame in one of opposite axial directions of said drive shaft.

17. The image-recording apparatus according to claim 16, wherein said proximal end portion of said support arm includes a side member extending perpendicularly to said opposite axial directions of said drive shaft, and said support frame includes a support portion which is opposed to said side member in said opposite axial directions, and wherein said torsion spring further includes an intermediate coil portion, and said side member, said support portion and said intermediate coil portion are arranged such that one of said side member and said support portion is interposed between said intermediate coil portion and the other of said side member and said support portion, such that said side member and said support portion are biased against each other by said torsion spring.

18. The image-recording apparatus according to claim 16, wherein said support arm includes a pair of elongate side plates extending in a longitudinal direction thereof perpendicular to said opposite axial directions of said drive shaft, and said support frame includes a pair of support plates which are opposed to each other in said opposite axial directions and between which proximal end portions of said pair of elongate side plates of said support arm are positioned, and wherein said torsion spring further includes an intermediate coil portion fitted on a portion of said drive shaft which is located between said pair of elongate side plates of said support arm, said other of said opposite end portions of said torsion spring being held in pressing contact with an outer surface of one of said pair of support plates which corresponds to said one of opposite axial directions of said drive shaft, whereby said support arm is biased by said torsion spring against said one support plate in said one of opposite axial directions.

19. The image-recording apparatus according to claim 18, wherein said one of said opposite end portions of said torsion spring is fixed to a retainer portion formed integrally with said proximal end portion of said support arm.

20. The image-recording apparatus according to claim 18, further comprising a gear train which connects said drive shaft to said rotary medium-supply member and which is disposed between said pair of elongate side plates of said support arm such that said gear train is located nearer to one of said pair of elongate side plates which corresponds to the other of said pair of support plates, than to the other of said pair of elongate side plates, and wherein said coil portion of said torsion spring is located nearer to said other elongate side plate than to said one elongate side plate.

21. The image-recording apparatus according to claim 14, wherein said medium feeding device is a lower medium feeding device operable to feed the recording media from the stack of the recording media accommodated in a lower one of two medium supply cassettes which are superposed on each other, said one of the two medium supply cassettes having a larger maximum height of the stack that can be accommodated, than the other of the two medium supply cassettes.

22. The image-recording apparatus according to claim 18, wherein said support frame is a generally planar member located above each of said medium supply cassettes, said generally planar member including said pair of support plates formed by bending respective portions thereof so as to extend downwards toward each of said medium supply cassettes.

23. The image recording apparatus according to claim 1, wherein said engaging portion of said power-transmission switching device is a first engaging portion, and said carriage has a second engaging portion engageable with said first engaging portion to move said shift gear.

* * * * *

UNITED STATES PATENT AND TRADEMARK OFFICE

CERTIFICATE OF CORRECTION

PATENT NO. : 7,464,922 B2
APPLICATION NO. : 11/211599
DATED : December 16, 2008
INVENTOR(S) : Daisuke Kozaki et al.

It is certified that error appears in the above-identified patent and that said Letters Patent is hereby corrected as shown below:

In Column 30, Claim 11, Line 7:
Please replace "angel small" with --angle smaller--

Signed and Sealed this

Eleventh Day of August, 2009

David J. Kappos

David J. Kappos
*Director of the United States Patent and Trademark Office*